US007025137B2

(12) United States Patent
Zupanick

(10) Patent No.: US 7,025,137 B2
(45) Date of Patent: Apr. 11, 2006

(54) THREE-DIMENSIONAL WELL SYSTEM FOR ACCESSING SUBTERRANEAN ZONES

(75) Inventor: Joseph A. Zupanick, Pineville, WV (US)

(73) Assignee: CDX Gas, LLC, Dallas, TX (US)

( * ) Notice: Subject to any disclaimer, the term of this patent is extended or adjusted under 35 U.S.C. 154(b) by 146 days.

(21) Appl. No.: 10/244,083

(22) Filed: Sep. 12, 2002

(65) Prior Publication Data

US 2004/0050552 A1 Mar. 18, 2004

(51) Int. Cl.
*E21B 43/30* (2006.01)

(52) U.S. Cl. ..... 166/245; 166/50; 166/313; 166/366; 175/61

(58) Field of Classification Search ..... 166/245, 166/366, 313, 52, 50, 54.1, 117.5, 117.6, 166/242.3; 175/57, 61
See application file for complete search history.

(56) References Cited

U.S. PATENT DOCUMENTS

| | | | |
|---|---|---|---|
| 54,144 | A | 4/1866 | Hamar |
| 274,740 | A | 3/1883 | Douglass |
| 526,708 | A | 10/1894 | Horton |
| 639,036 | A | 12/1899 | Heald |

(Continued)

FOREIGN PATENT DOCUMENTS

| | | |
|---|---|---|
| AU | 85/49964 | 11/1986 |
| CA | 2210866 | 1/1998 |
| CA | 2 278 735 | 1/1998 |
| DE | 653 741 | 1/1986 |

(Continued)

OTHER PUBLICATIONS

Notification of Transmittal of the International Search Report and the Written Opinion of the International Searching Authority, or the Declaration (3 pages), International Search Report (5 pages) and Written Opinion of the International Searching Authority (6 pages) re International Application No. PCT/US2004/012029 mailed Sep. 22, 2004.

Brunner, D.J. and Schwoebel, J.J., "Directional Drilling for Methane Drainage and Exploration in Advance of Mining," REI Drilling Directional Underground, World Coal, 1999, 10 pages.

Thakur, P.C., "A History of Coalbed Methane Drainage From United States Coal Mines," 2003 SME Annual Meeting, Feb. 24–26, Cincinnati, Ohio, 4 pages.

U.S. Climate Change Technology Program, "Technology Options for the Near and Long Term," 4.1.5 Advances in Coal Mine Methane Recovery Systems, pp. 162–164.

Notification of Transmittal of the International Search Report and the Written Opinion of the International Searching Authority, or the Declaration (3 pages), International Search Report (3 pages) and Written Opinion of the International Searching Authority (7 pages) re International Application No. PCT/US2004/017048 mailed Oct. 21, 2004.

Gardes, Robert, "Multi–Seam Completion Technology," Natural Gas Quarterly, E&P, Jun. 2004, pp. 78–81.

(Continued)

*Primary Examiner*—David Bagnell
*Assistant Examiner*—Jennifer H Gay
(74) *Attorney, Agent, or Firm*—Fish & Richardson P.C.

(57) ABSTRACT

A drainage system for accessing multiple subterranean zones from the surface includes an entry well extending from the surface. The system also includes two or more exterior drainage wells extending from the entry well through the subterranean zones. The exterior drainage wells each extend outwardly and downwardly from the entry well for a first selected distance and then extend downwardly in a substantially vertical orientation for a second selected distance.

46 Claims, 7 Drawing Sheets

U.S. PATENT DOCUMENTS

| | | | | |
|---|---|---|---|---|
| 1,189,560 | A | 7/1916 | Gondos | |
| 1,285,347 | A | 11/1918 | Otto | |
| 1,467,480 | A | 9/1923 | Hogue | |
| 1,485,615 | A | 3/1924 | Jones | |
| 1,488,106 | A | 3/1924 | Fitzpatrick | |
| 1,520,737 | A | 12/1924 | Wright | |
| 1,674,392 | A | 6/1928 | Flansburg | |
| 1,777,961 | A | 10/1930 | Capeliuschnicoff | |
| 2,018,285 | A | 10/1935 | Schweitzer et al. | 166/21 |
| 2,069,482 | A | 2/1937 | Seay | 255/76 |
| 2,150,228 | A | 3/1939 | Lamb | 166/10 |
| 2,169,718 | A | 8/1939 | Boll et al. | 255/24 |
| 2,335,085 | A | 11/1943 | Roberts | 251/197 |
| 2,450,223 | A | 9/1948 | Barbour | 255/76 |
| 2,490,350 | A | 12/1949 | Grable | 166/4 |
| 2,679,903 | A | 6/1954 | McGowen, Jr. et al. | 166/1 |
| 2,726,063 | A | 12/1955 | Ragland et al. | 255/1.8 |
| 2,726,847 | A | 12/1955 | McCune et al. | 255/1.6 |
| 2,783,018 | A | 2/1957 | Lytle | 251/25 |
| 2,797,893 | A | 7/1957 | McCune et al. | |
| 2,847,189 | A | 8/1958 | Shook | 255/76 |
| 2,911,008 | A | 11/1959 | Du Bois | 137/625.31 |
| 2,980,142 | A | 4/1961 | Turak | 137/637.3 |
| 3,208,537 | A | 9/1965 | Scarborough | 175/53 |
| 3,347,595 | A | 10/1967 | Dahms et al. | 299/4 |
| 3,385,382 | A | 5/1968 | Canalizo et al. | |
| 3,443,648 | A | 5/1969 | Howard | 175/103 |
| 3,473,571 | A | 10/1969 | Dugay | 137/625.4 |
| 3,503,377 | A | 3/1970 | Beatenbough et al. | 123/117 |
| 3,528,516 | A | 9/1970 | Brown | 175/267 |
| 3,530,675 | A | 9/1970 | Turzillo | 61/35 |
| 3,582,138 | A | 6/1971 | Loofbourow et al. | |
| 3,587,743 | A | 6/1971 | Howard | |
| 3,684,041 | A | 8/1972 | Kammerer, Jr. et al. | 175/267 |
| 3,692,041 | A | 9/1972 | Bondi | 137/238 |
| 3,744,565 | A | 7/1973 | Brown | |
| 3,757,876 | A | 9/1973 | Pereau | 175/267 |
| 3,757,877 | A | 9/1973 | Leathers | 175/269 |
| 3,800,830 | A | 4/1974 | Etter | 137/625.41 |
| 3,809,519 | A | 5/1974 | Garner | 425/245 |
| 3,825,081 | A | 7/1974 | McMahon | 175/73 |
| 3,828,867 | A | 8/1974 | Elwood | 175/45 |
| 3,874,413 | A | 4/1975 | Valdez | 137/625.47 |
| 3,887,008 | A | 6/1975 | Canfield | 166/267 |
| 3,902,322 | A | 9/1975 | Watanabe | 61/35 |
| 3,907,045 | A | 9/1975 | Dahl et al. | 175/45 |
| 3,934,649 | A | 1/1976 | Pasini, III et al. | 166/254 |
| 3,957,082 | A | 5/1976 | Fuson et al. | 137/625.41 |
| 3,961,824 | A | 6/1976 | Van Eek et al. | 299/17 |
| 4,011,890 | A | 3/1977 | Andersson | 137/625.4 |
| 4,020,901 | A | 5/1977 | Pisio et al. | |
| 4,022,279 | A | 5/1977 | Driver | 166/271 |
| 4,030,310 | A | 6/1977 | Schirtzinger | |
| 4,037,658 | A | 7/1977 | Anderson | 166/272 |
| 4,060,130 | A | 11/1977 | Hart | |
| 4,073,351 | A | 2/1978 | Baum | 175/14 |
| 4,089,374 | A | 5/1978 | Terry | 166/259 |
| 4,116,012 | A | 9/1978 | Abe et al. | 405/238 |
| 4,134,463 | A | 1/1979 | Allen | 175/53 |
| 4,136,996 | A | 1/1979 | Burns | |
| 4,151,880 | A | 5/1979 | Vann | |
| 4,156,437 | A | 5/1979 | Chivens et al. | 137/554 |
| 4,169,510 | A | 10/1979 | Meigs | 175/65 |
| 4,182,423 | A | 1/1980 | Ziebarth et al. | |
| 4,189,184 | A | 2/1980 | Green | 299/8 |
| 4,220,203 | A | 9/1980 | Steeman | 166/271 |
| 4,221,433 | A | 9/1980 | Jacoby | 299/4 |
| 4,222,611 | A | 9/1980 | Larson et al. | |
| 4,224,989 | A | 9/1980 | Blount | 166/250 |
| 4,226,475 | A | 10/1980 | Frosch et al. | |
| 4,257,650 | A | 3/1981 | Allen | 299/2 |
| 4,278,137 | A | 7/1981 | Van Eek | 175/267 |
| 4,283,088 | A | 8/1981 | Tabakov et al. | 299/2 |
| 4,296,785 | A | 10/1981 | Vitello et al. | 141/105 |
| 4,299,295 | A | 11/1981 | Gossard | 175/45 |
| 4,303,127 | A | 12/1981 | Freel et al. | |
| 4,305,464 | A | 12/1981 | Masszi | 166/370 |
| 4,312,377 | A | 1/1982 | Knecht | 137/625.19 |
| 4,317,492 | A | 3/1982 | Summers et al. | 175/79 |
| 4,328,577 | A | 5/1982 | Abbott et al. | 370/84 |
| 4,333,539 | A | 6/1982 | Lyons et al. | 175/61 |
| 4,366,988 | A | 1/1983 | Bodine | 299/14 |
| 4,372,398 | A | 2/1983 | Kuckes | 175/45 |
| 4,386,665 | A | 6/1983 | Dellinger | 175/61 |
| 4,390,067 | A | 6/1983 | Willman | 166/245 |
| 4,396,076 | A | 8/1983 | Inoue | 175/265 |
| 4,397,360 | A | 8/1983 | Schmidt | 175/61 |
| 4,401,171 | A | 8/1983 | Fuchs | 175/267 |
| 4,407,376 | A | 10/1983 | Inoue | 175/267 |
| 4,415,205 | A | 11/1983 | Rehm et al. | |
| 4,417,829 | A | 11/1983 | Berezoutzky | |
| 4,422,505 | A | 12/1983 | Collins | |
| 4,437,706 | A | 3/1984 | Johnson | 299/7 |
| 4,442,896 | A | 4/1984 | Reale et al. | 166/278 |
| 4,463,988 | A | 8/1984 | Bouck et al. | |
| 4,494,616 | A | 1/1985 | McKee | 175/67 |
| 4,502,733 | A | 3/1985 | Grubb | |
| 4,512,422 | A | 4/1985 | Knisley | 175/99 |
| 4,519,463 | A | 5/1985 | Schuh | 175/61 |
| 4,527,639 | A | 7/1985 | Dickinson, III et al. | 175/61 |
| 4,532,986 | A | 8/1985 | Mims et al. | 166/50 |
| 4,533,182 | A | 8/1985 | Richards | |
| 4,536,035 | A | 8/1985 | Huffman et al. | |
| 4,544,037 | A | 10/1985 | Terry | 166/369 |
| 4,558,744 | A | 12/1985 | Gibb | 166/335 |
| 4,565,252 | A | 1/1986 | Campbell et al. | 175/269 |
| 4,573,541 | A | 3/1986 | Josse et al. | 175/78 |
| 4,599,172 | A | 7/1986 | Gardes | 210/314 |
| 4,600,061 | A | 7/1986 | Richards | 175/62 |
| 4,603,592 | A | 8/1986 | Siebold et al. | |
| 4,605,076 | A | 8/1986 | Goodhart | 175/61 |
| 4,611,855 | A | 9/1986 | Richards | 299/2 |
| 4,618,009 | A | 10/1986 | Carter et al. | 175/267 |
| 4,638,949 | A | 1/1987 | Mancel | 239/307 |
| 4,646,836 | A | 3/1987 | Goodhart | 166/303 |
| 4,651,836 | A | 3/1987 | Richards | |
| 4,674,579 | A | 6/1987 | Geller et al. | 175/45 |
| 4,702,314 | A | 10/1987 | Huang et al. | 166/245 |
| 4,705,431 | A | 11/1987 | Gadelle et al. | 405/267 |
| 4,715,440 | A | 12/1987 | Boxell et al. | 166/100 |
| 4,753,485 | A | 6/1988 | Goodhart | |
| 4,754,819 | A | 7/1988 | Dellinger | 175/61 |
| 4,756,367 | A | 7/1988 | Puri et al. | 166/263 |
| 4,763,734 | A | 8/1988 | Dickinson et al. | 175/61 |
| 4,773,488 | A | 9/1988 | Bell et al. | 175/61 |
| 4,776,638 | A | 10/1988 | Hahn | |
| 4,830,105 | A | 5/1989 | Petermann | 166/241 |
| 4,832,122 | A | 5/1989 | Corey et al. | |
| 4,836,611 | A | 6/1989 | El-Saie | 299/7 |
| 4,842,081 | A | 6/1989 | Parant | 175/23 |
| 4,844,182 | A | 7/1989 | Tolle | 175/215 |
| 4,852,666 | A | 8/1989 | Brunet et al. | 175/61 |
| 4,883,122 | A | 11/1989 | Puri et al. | 166/248 |
| 4,889,186 | A | 12/1989 | Hanson et al. | |
| 4,978,172 | A | 12/1990 | Schwoebel et al. | 299/12 |
| 5,016,710 | A | 5/1991 | Renard et al. | 166/245 |
| 5,035,605 | A | 7/1991 | Dinerman et al. | 481/18 |
| 5,036,921 | A | 8/1991 | Pittard et al. | 166/298 |
| 5,074,360 | A | 12/1991 | Guinn | 166/281 |
| 5,074,365 | A | 12/1991 | Kuckes | 175/40 |
| 5,074,366 | A | 12/1991 | Karlsson et al. | 175/76 |

5,082,054 A 1/1992 Kiamanesh ..... 166/248
5,111,893 A 5/1992 Kvello-Aune ..... 175/258
5,121,244 A 6/1992 Takasaki
5,127,457 A 7/1992 Stewart et al.
5,135,058 A 8/1992 Millgard et al. ..... 175/71
5,148,875 A 9/1992 Karlsson et al. ..... 175/62
5,148,877 A 9/1992 MacGregor
5,165,491 A 11/1992 Wilson ..... 175/62
5,168,942 A 12/1992 Wydrinski ..... 175/50
5,174,374 A 12/1992 Hailey ..... 166/55.8
5,193,620 A 3/1993 Braddick ..... 166/382
5,194,859 A 3/1993 Warren ..... 340/853.4
5,194,977 A 3/1993 Nishio
5,197,553 A 3/1993 Leturno ..... 175/57
5,197,783 A 3/1993 Theimer et al. ..... 299/17
5,199,496 A 4/1993 Redus et al. ..... 166/366
5,201,817 A 4/1993 Hailey ..... 175/269
5,217,076 A 6/1993 Masek ..... 166/303
5,226,495 A 7/1993 Jennings, Jr. ..... 166/278
5,240,350 A 8/1993 Yamaguchi et al. ..... 405/143
5,242,017 A 9/1993 Hailey ..... 166/55.8
5,242,025 A 9/1993 Neill et al. ..... 175/26
5,246,273 A 9/1993 Rosar ..... 299/4
5,255,741 A 10/1993 Alexander ..... 166/278
5,271,472 A 12/1993 Leturno ..... 175/107
5,287,926 A 2/1994 Grupping
5,301,760 A 4/1994 Graham ..... 175/61
5,355,967 A 10/1994 Mueller et al.
5,363,927 A 11/1994 Frank ..... 175/67
5,385,205 A 1/1995 Hailey ..... 166/55.8
5,394,950 A 3/1995 Gardes ..... 175/45
5,402,851 A 4/1995 Baiton ..... 166/369
5,411,082 A 5/1995 Kennedy ..... 166/181
5,411,085 A 5/1995 Moore et al. ..... 166/242
5,411,088 A 5/1995 LeBlanc et al. ..... 166/265
5,411,104 A 5/1995 Stanley ..... 175/65
5,411,105 A 5/1995 Gray ..... 175/69
5,431,220 A 7/1995 Lennon et al. ..... 166/55.7
5,431,482 A 7/1995 Russo
5,435,400 A 7/1995 Smith ..... 175/61
5,450,902 A 9/1995 Matthews ..... 166/268
5,454,419 A 10/1995 Vloedman ..... 166/277
5,458,209 A 10/1995 Hayes et al. ..... 175/61
5,462,116 A 10/1995 Carroll ..... 166/249
5,462,120 A 10/1995 Gondouin ..... 166/380
5,469,155 A 11/1995 Archambeault et al. . 340/853.4
5,477,923 A 12/1995 Jordan, Jr. et al. ..... 66/313
5,485,089 A 1/1996 Kuckes ..... 324/346
5,494,121 A 2/1996 Nackerud ..... 175/263
5,499,687 A 3/1996 Lee ..... 175/317
5,501,273 A 3/1996 Puri ..... 166/252.5
5,501,279 A 3/1996 Garg et al. ..... 166/372
5,584,605 A 12/1996 Beard et al. ..... 405/128
5,613,242 A 3/1997 Oddo
5,615,739 A 4/1997 Dallas ..... 166/306
5,653,286 A 8/1997 McCoy et al. ..... 166/105.5
5,669,444 A 9/1997 Riese et al. ..... 166/263
5,676,207 A 10/1997 Simon et al.
5,680,901 A 10/1997 Gardes ..... 166/313
5,690,390 A 11/1997 Bithell ..... 299/4
5,697,445 A 12/1997 Graham
5,706,871 A 1/1998 Andersson et al. ..... 141/59
5,720,356 A 2/1998 Gardes ..... 175/62
5,727,629 A 3/1998 Blizzard, Jr. et al. ..... 166/298
5,735,350 A 4/1998 Longbottom et al. ..... 166/313
5,771,976 A 6/1998 Talley ..... 166/370
5,775,433 A 7/1998 Hammett et al. ..... 166/98
5,775,443 A 7/1998 Lott
5,785,133 A 7/1998 Murray et al. ..... 175/61
5,832,958 A 11/1998 Cheng ..... 137/625.41
5,853,054 A 12/1998 McGarian et al. ..... 175/267
5,853,056 A 12/1998 Landers ..... 175/424
5,863,283 A 1/1999 Gardes ..... 588/250
5,868,202 A 2/1999 Hsu ..... 166/256
5,868,210 A 2/1999 Johnson et al. ..... 175/40
5,879,057 A 3/1999 Schwoebel et al. ..... 299/17
5,884,704 A 3/1999 Longbottom et al. ..... 16/313
5,917,325 A 6/1999 Smith ..... 324/326
5,934,390 A 8/1999 Uthe ..... 175/67
5,938,004 A 8/1999 Roberts et al. ..... 198/812
5,957,539 A 9/1999 Durup et al. ..... 299/4
5,971,074 A 10/1999 Longbottom et al. ..... 166/313
6,012,520 A 1/2000 Yu et al. ..... 166/245
6,015,012 A 1/2000 Reddick ..... 166/313
6,019,173 A 2/2000 Saurer et al.
6,024,171 A 2/2000 Montgomery et al. ..... 166/308
6,030,048 A 2/2000 Hsu
6,050,335 A 4/2000 Parsons ..... 166/272.3
6,062,306 A 5/2000 Gano et al.
6,065,550 A 5/2000 Gardes ..... 175/62
6,065,551 A 5/2000 Gourley et al.
6,119,771 A 9/2000 Gano et al. ..... 166/50
6,119,776 A 9/2000 Graham et al.
6,135,208 A 10/2000 Gano et al. ..... 166/313
6,179,054 B1 1/2001 Stewart ..... 166/105.5
6,189,616 B1 2/2001 Gano et al.
6,209,636 B1 4/2001 Roberts et al. ..... 166/117.6
6,237,284 B1 5/2001 Erickson
6,244,340 B1 6/2001 McGlothen et al.
6,279,658 B1 8/2001 Donovan et al.
6,280,000 B1 8/2001 Zupanick ..... 299/12
6,349,769 B1 2/2002 Ohmer ..... 166/313
6,357,523 B1 3/2002 Zupanick ..... 166/52
6,357,530 B1 3/2002 Kennedy et al. ..... 166/369
6,425,448 B1 7/2002 Zupanick et al. ..... 175/61
6,450,256 B1 9/2002 Mones
6,454,000 B1 9/2002 Zupanick
6,457,540 B1 10/2002 Gardes
6,497,556 B1 12/2002 Zupanick et al.
6,566,649 B1 5/2003 Mickael ..... 250/269.3
6,571,888 B1 6/2003 Comeau et al. ..... 175/61
6,575,255 B1 6/2003 Rial et al.
6,577,129 B1 6/2003 Thompson et al. ..... 324/338
6,585,061 B1 7/2003 Radzinski et al. ..... 175/45
6,590,202 B1 7/2003 Mickael ..... 250/269.2
6,591,903 B1 7/2003 Ingle et al. ..... 166/50
6,591,922 B1 7/2003 Rial et al.
6,595,301 B1 7/2003 Diamond et al.
6,595,302 B1 7/2003 Diamond et al.
6,604,910 B1 8/2003 Zupanick
6,607,042 B1 8/2003 Hoyer et al. ..... 175/38
6,636,159 B1 10/2003 Winnacker ..... 340/854.3
6,639,210 B1 10/2003 Odom et al. ..... 250/269.6
6,644,422 B1 11/2003 Rial et al.
6,646,441 B1 11/2003 Thompson et al.
6,653,839 B1 11/2003 Yuratich et al. ..... 324/355
6,679,322 B1 1/2004 Zupanick
6,722,452 B1 4/2004 Rial et al.
6,745,855 B1 6/2004 Gardes
6,758,279 B1 7/2004 Moore et al.
2001/0010432 A1 8/2001 Zupanick
2001/0015574 A1 8/2001 Zupanick et al.
2002/0043404 A1 4/2002 Trueman et al.
2002/0050358 A1 5/2002 Algeroy et al. ..... 166/313
2002/0074120 A1 6/2002 Scott ..... 166/313
2002/0074122 A1 6/2002 Kelley et al.
2002/0096336 A1 7/2002 Zupanick et al.
2003/0066686 A1 4/2003 Conn ..... 175/57
2003/0075334 A1 4/2003 Haugen et al.
2003/0164253 A1 9/2003 Trueman et al.
2003/0217842 A1 11/2003 Zupanick
2003/0221836 A1 12/2003 Gardes

| | | | |
|---|---|---|---|
| 2004/0011560 | A1 | 1/2004 | Rial et al. |
| 2004/0031609 | A1 | 2/2004 | Zupanick |
| 2004/0033557 | A1 | 2/2004 | Scott et al. |
| 2004/0050554 | A1 | 3/2004 | Zupanick et al. |
| 2004/0055787 | A1 | 3/2004 | Zupanick |
| 2004/0060351 | A1 | 4/2004 | Gunter et al. |
| 2004/0140129 | A1 | 7/2004 | Gardes |
| 2004/0226717 | A1 | 11/2004 | Morgan et al. |

FOREIGN PATENT DOCUMENTS

| | | | |
|---|---|---|---|
| DE | 197 25 996 | A1 | 1/1998 |
| EP | 0 819 834 | A1 | 1/1998 |
| EP | 0 875 661 | A1 | 11/1998 |
| EP | 0 952 300 | A1 | 10/1999 |
| EP | 1 316 673 | A2 | 6/2003 |
| FR | 964503 | | 8/1950 |
| GB | 442088 | | 1/1936 |
| GB | 444484 | | 3/1936 |
| GB | 651468 | | 4/1951 |
| GB | 893869 | | 4/1962 |
| GB | 750108 | | 6/1975 |
| GB | 1448078 | A1 | 3/1987 |
| GB | 1770570 | A1 | 3/1990 |
| GB | 2 255 033 | | 10/1992 |
| GB | 2 297 988 | | 8/1996 |
| SU | 750108 | | 6/1975 |
| SU | 876968 | | 10/1981 |
| SU | 1448078 | A1 | 3/1987 |
| SU | 1770570 | A1 | 3/1990 |
| WO | 94/21889 | | 9/1994 |
| WO | WO 94/28280 | | 12/1994 |
| WO | WO 97/21900 | | 6/1997 |
| WO | WO 98/35133 | | 8/1998 |
| WO | 00/31376 | | 6/2000 |
| WO | WO 01/44620 | | 6/2001 |
| WO | WO 02/18738 | | 3/2002 |
| WO | WO 02/061238 | | 8/2002 |
| WO | WO 03/102348 | | 12/2003 |
| WO | WO 2004/035984 | A1 | 4/2004 |

OTHER PUBLICATIONS

Baiton, Nicholas, "Maximize Oil Production and Recovery," Vertizontal Brochure, received Oct. 2, 2002, 4 pages.

Dreiling, Tim, McClelland, M.L. and Bilyeu, Brad, "Horizontal & High Angle Air Drilling in the San Juan Basin, New Mexico," Believed to be dated Apr. 1996, pp. 1–11.

Fong, David K., Wong, Frank Y., and McIntyre, Frank J., "An Unexpected Benefit of Horizontal Wells on Offset Vertical Well Productivity in Vertical Miscible Floods," Canadian SPE/CIM/CANMET Paper No. HWC94–09, paper to be presented Mar. 20–23, 1994, Calgary, Canada, 10 pages.

Fischer, Perry A., "What's Happening in Production," World Oil, Jun. 2001, p. 27.

Website of PTTC Network News vol. 7, 1st Quarter 2001, Table of Contents, http://www.pttc.org/../news/v7n1nn4.htm printed Apr. 25, 2003, 3 pages.

Cox, Richard J.W., "Testing Horizontal Wells While Drilling Underbalanced," Delft University of Technology, Aug. 1998, 68 pages.

McLennan, John, et al., "Underbalanced Drilling Manual," Gas Research Institute, Chicago, Illinois, GRI Reference No. GRI–97/0236, copyright 1997, 502 pages.

The Need for a Viable Multi–Seam Completion Technology for the Powder River Basin, Current Practice and Limitations, Gardes Energy Services, Inc., Believed to be 2003 (8 pages).

Langley, Diane, "Potential Impact of Microholes Is Far From Diminutive," JPT Online, http://www.spe.org/spe/jpt/jps, Nov. 2004 (5 pages).

Consol Energy Slides, "Generating Solutions, Fueling Change," Presented at Appalachian E&P Forum, Harris Nesbitt Corp., Boston, Oct. 14, 2004 (29 pages).

Notification of Transmittal of the International Search Report and the Written Opinion of the International Searching Authority, or the Declaration (3 pages), International Search Report (3 pages), and Written Opinion of the International Searching Authority (5 pages) re International Application No. PCT/US2004/024518 mailed Nov. 10, 2004.

Schenk, Christopher J., "Geologic Definition and Resource Assessment of Continuous (Unconventional) Gas Accumulations—the U.S. Experience," Website, http://aapg.confex.com/ . . . //, printed Nov. 16, 2004 (1 page).

U.S. Department of Interior, U.S. Geological Survey, "Characteristics of Discrete and Basin–Centered Parts of the Lower Silurian Regional Oil and Gas Accumulation, Appalachian Basin: Preliminary Results From a Data Set of 25 oil and Gas Fields," U.S. Geololgical Survey Open–File Report 98–216, Website, http://pubs.usgs.gov/of/1998/of98–216/introl.htm, printed Nov. 16, 2004 (2 pages).

Zupanick, J., "Coalbed Methane Extraction," 28th Mineral Law Conference, Lexington, Kentucky, Oct. 16–17, 2003 (48 pages).

Zupanick, J., "CDX Gas—Pinnacle Project," Presentation at the 2002 Fall Meeting of North American Coal Bed Methane Forum, Morgantown, West Virginia, Oct. 30, 2002 (23 pages).

Lukas, Andrew, Lucas Drilling Pty Ltd., "Technical Innovation and Engineering Xstrata—Oaky Creek Coal Pty Limited," Presentation at Coal Seam Gas & Mine Methane Conference in Brisbane, Nov. 22–23, 2004 (51 pages).

Field, Tony, Mitchell Drilling, "Let's Get Technical—Drilling Breakthroughs in Surface to In–Seam in Australia," Presentation at Coal Seam Gas & Mine Methane Conference in Brisbane, Nov. 22–23, 2004 (20 pages).

Zupanick, Joseph A, "Coal Mine Methane Drainage Utilizing Multilateral Horizontal Wells," 2005 SME Annual Meeting & Exhibit, Feb. 28—Mar. 2, 2005, Salt Lake City, Utah (6 pages).

The Official Newsletter of the Cooperative Research Centre for Mining Technology and Equipment, CMTE News 7, "Tight–Radius Drilling Clinches Award," Jun. 2001, 1 page.

Listing of 174 References received from Third Party on Feb. 16, 2005 (9 pages).

Gardes Directional Drilling, "Multiple Directional Wells From Single Borehole Developed," Reprinted from Jul. 1989 edition of Offshore, Copyright 1989 by PennWell Publishing Company (4 pages).

"Economic Justification and Modeling of Multilateral Wells," Economic Analysis, Hart's Petroleum Engineer International, 1997 (4 pages).

Mike Chambers, "Multi–Lateral Completions at Mobil Past, Present, and Future," presented at the 1998 Summit on E&P Drilling Technologies, Strategic Research Institute, Aug. 18–19, 1998 in San Antonio, Texas (26 pages).

David C. Oyler and William P. Diamond, "Drilling a Horizontal Coalbed Methane Drainage System From a Directional Surface Borehole," PB82221516, National Technical Information Service, Bureau of Mines, Pittsburgh, PA, Pittsburgh Research Center, Apr. 1982 (56 pages).

P. Corlay, D. Bossie–Codreanu, J.C. Sabathier and E.R. Delamaide, "Improving Reservoir Management With Complex Well Architectures," Field Production & Reservoir Management, World Oil, Jan. 1997 (5 pages).

Eric R. Skonberg and Hugh W. O'Donnell, "Horizontal Drilling for Underground Coal Gasification," presented at the Eighth Underground Coal Conversion Symposium, Keystone, Colorado, Aug. 16, 1982 (8 pages).

Gamal Ismail, A.S. Fada'q, S. Kikuchi, H. El Khatib, "Ten Years Experience in Horizontal Application & Pushing the Limits of Well Construction Approach in Upper Zakum Field (Offshore Abu Dhabi)," SPE 87284, Society of Petroleum Engineers, Oct. 2000 (17 pages).

Gamal Ismail, H. El–Khatib—ZADCO, Abu Dhabi, UAE, "Multi–Lateral Horizontal Drilling Problems & Solutions Experience Offshore Abu Dhabi," SPE 36252, Society of Petroleum Engineers, Oct. 1996 (12 pages).

C.M. Matthews and L.J. Dunn, "Drilling and Production Practices to Mitigate Sucker Rod/Tubing Wear–Related Failures in Directional Wells," SPE 22852, Society of Petroleum Engineers, Oct. 1991 (12 pages).

H.H. Fields, Stephen Krickovic, Albert Sainato, and M.G. Zabetakis, "Degasification of Virgin Pittsburgh Coalbed Through a Large Borehole," RI–7800, Bureau of Mines Report of Investigations/1973, United States Department of the Interior, 1973 (31 pages).

William P. Diamond, "Methane Control for Underground Coal Mines," IC–9395, Bureau of Mines Information Circular, Unites States Department of the Interior, 1994 (51 pages).

Technology Scene Drilling & Intervention Services, "Weatherford Moves Into Advanced Multilateral Well Completion Technology" and "Productivity Gains and Safety Record Speed Acceptance of UBS," *Reservoir Mechanics*, Weatherford International, Inc., 2000 Annual Report (2 pages).

"A Different Direction for CBM Wells," *W Magazine*, 2004 Third Quarter (5 pages).

Snyder, Robert E., "What's New in Production," *WorldOil Magazine*, Feb. 2005, [printed from the internet on Mar. 7, 2005], http://www.worldoil.com/magazine/MAGAZINE_DETAIL.asp? ART_ID=2507@MONTH_YEAR (3 pages).

Nazzal, Greg, "Moving Multilateral Systems to the Next Level, Strategic Acquisition Expands Weatherford's Capabilities," 2000 (2 pages).

Bahr, Angie, "Methane Draining Technology Boosts Safety and Energy Production," Energy Review, Feb. 4, 2005, Website: www.energyreview.net/storyviewprint.asp, printed Feb. 7, 2005 (2 pages).

Molvar, Erik M., "Drilling Smarter: Using Directional Drilling to Reduce Oil and Gas Impacts in the Intermountain West," Prepared by Biodiversity Conservation Alliance, Report issued Feb. 18, 2003, 34 pages.

King, Robert F., "Drilling Sideways—A Review of Horizontal Well Technology and Its Domestic Application," DOE/EIA–TR–0565, U.S. Department of Energy, Apr. 1993, 30 pages.

Santos, Helio, SPE, Impact Engineering Solutions and Jesus Olaya, Ecopetrol/ICP, "*No–Damage Drilling: How to Achieve this Challenging Goal*?," SPE 77189, Copyright 2002, presented at the IADC/SPE Asia Pacific Drilling Technology, Jakarta, Indonesia, Sep. 9–11, 2002, 10 pages.

Santos, Helio, SPE, Impact Engineering Solutions, "*Increasing Leakoff Pressure with New Class of Drilling Fluid*," SPE 78243, Copyright 2002, presented at the SPE/ISRM Rock Mechanics Conference in Irving, Texas, Oct. 20–23, 2002, 7 pages.

Franck Labenski, Paul Reid, SPE, and Helio Santos, SPE, Impact Solutions Group, "*Drilling Fluids Approaches for Control of Wellbore Instability in Fractured Formations*," SPE/IADC 85304, Society of Petroleum Engineers, Copyright 2003, presented at the SPE/IADC Middle East Drilling Technology Conference & Exhibition in Abu Chabi, UAE, Oct. 20–22, 2003, 8 pages.

P. Reid, SPE, and H. Santos, SPE, Impact Solutions Group, "*Novel Drilling, Completion and Workover Fluids for Depleted Zones: Avoiding Losses, Formation Damage and Stuck Pipe*," SPE/IADC 85326, Society of Petroleum Engineers, Copyright 2003, presented at the SPE/IADC Middle East Drilling Conference & Exhibition in Abu Chabi, UAE, Oct. 20–22, 2003, 9 pages.

Craig C. White and Adrian P. Chesters, NAM; Catalin D. Ivan, Sven Maikranz and Rob Nouris, M–I L.L.C., "*Aphron–based drilling fluid: Novel technology for drilling depleted formations*," World Oil, Drilling Report Special Focus, Oct. 2003, 5 pages.

Robert E. Snyder, "Drilling Advances," World Oil, Oct. 2003, 1 page.

U.S. Environmental Protection Agency, "Directional Drilling Technology," prepared for the EPA by Advanced Resources International under Contract 68–W–00–094, Coalbed Methane Outreach Program (CMOP), Website: http://search.epa.gov/s97is.vts, printed Mar. 17, 2005, 13 pages.

"Meridian Tests New Technology," Western Oil World, Jun. 1990, Cover, Table of Contents and p. 13.

Clint Leazer and Michael R. Marquez, "Short–Radius Drilling Expands Horizontal Well Applications," Petroleum Engineer International, Apr. 1995, 6 pages.

Terry R. Logan, "Horizontal Drainhole Drilling Techniques Used in Rocky Mountains Coal Seams," Geology and Coal–Bed Methane Resources of the Northern San Juan Basin, Colorado and New Mexico, Rocky Mountain Association of Geologists, Coal–Bed Methane, San Juan Basin, 1988, pp. cover, 133–142.

Precision Drilling, "*We Have Roots in Coal Bed Methane Drilling*," Technology Services Group, Published on or before Aug. 5, 2002, 1 page, Published on or before Aug. 5, 2002.

Chi, Weiguo, "*A feasible discussion on exploitation coalbed methane through Horizontal Network Drilling in China*," SPE 64709, Society of Petroleum Engineers (SPE International), Nov. 7, 2000, 4 pages.

Notification of Transmittal of the International Search Report or the Declaration (PCT Rule 44.1) (3 pages) and International Search Report (4 pages) re International Application No. PCT/US 03/38383 mailed Jun. 2, 2004.

Kalinin, et al., Translation of Selected Pages from Ch. 4, Sections 4.2 (p. 135), 10.1 (p. 402), 10.4 (pp. 418–419), "*Drilling Inclined and Horizontal Well Bores*," Moscow, Nedra.

Jet Lavanway Exploration, "*Well Survey*," Key Energy Surveys, 3 pages, Nov. 2, 1997.

U.S. Dept. of Energy, "*New Breed of CBM/CMM Recovery Technology*," 1 page, Jul. 2003.

Ghiselin, Dick, "*Uncoventional Vision Frees Gas Reserves*," Natural Gas Quarterly, 2 pages, Sep. 2003.

CBM Review, World Coal, "*US Drilling into Asia*," 4 pages, Jun. 2003.

Skrebowski, Chris, "*US Interest in North Korean Reserves*," Petroleum, Energy Institute, 4 pages, Jul. 2003.

Diamond et al., U.S. Appl. No. 10/264,535, entitled "Method and System for Removing Fluid From a Subterranean Zone Using an Enlarged Cavity" filed Oct. 3, 2002.

Zupanick, U.S. Appl. No. 10/267,426, entitled "Method of Drilling Lateral Wellbores From a Slant Well Without Utilizing a Whipstock," filed Oct. 8, 2002.

Rial et al., U.S. Appl. No. 10/328,408, entitled "Method and System for Controlling the Production Rate Of Fluid From A Subterranean Zone To Maintain Production Bore Stability In The Zone," filed Dec. 23, 2002.

Zupanick, et al., U.S. Appl. No. 10/457,103, entitled "Method and System for Recirculating Fluid in a Well System," filed Jun. 5, 2003.

Zupanick, U.S. Appl. No. 10/630,345, entitled "Method and System for Accessing Subterranean Deposits from the Surface and Tools Therefor," filed Jul. 29, 2003.

Pauley, Steven, U.S. Appl. No. 10/715,300, entitled "Multi–Purpose Well Bores and Method for Accessing a Subterranean Zone From the Surface," filed Nov. 17, 2003.

Seams, Douglas, U.S. Appl. No. 10/723,322, entitled "Method and System for Extraction of Resources from a Subterranean Well Bore," filed Nov. 26, 2003.

Zupanick, U.S. Appl. No. 10/749,884, entitled "Slant Entry Well System and Method," filed Dec. 31, 2003.

Zupanick, U.S. Appl. No. 10/761,629, entitled "Method and System for Accessing Subterranean Deposits from the Surface," filed Jan. 20, 2004.

Zupanick, U.S. Appl. No. 10/769,221, entitled "Method and System for Testing A Partially Formed Hydrocarbon Well for Evaluation and Well Planning Refinement," filed Jan. 30, 2004.

Platt, "Method and System for Lining Multilateral Wells," U.S. Appl. No. 10/772,841, filed Feb. 5, 2004.

Zupanick, "Three–Dimentsional Well System For Accessing Subterranean Zones," U.S. Appl. No. 10/777,503, filed Feb. 11, 2004.

Zupanick, "System and Method for Directionial Drilling Utilizing Clutch Assembly," U.S. Appl. No. 10/811,118, filed Mar. 25, 2004.

Zupanick et al., "Slot Cavity," U.S. Appl. No. 10/419,529, filed Apr. 21, 2003.

Zupanick, "System and Method for Multiple Wells from a Common Surface Location," U.S. Appl. No. 10/788,694, filed Feb. 27, 2004.

Palmer, Ian D., et al., "*Coalbed Methane Well Completions and Stimulations*," Chapter 14, Hydrocarbons From Coal, American Association of Petroleum Geologists, 1993, pp. 303–339.

Field, T.W., "*Surface to In–seam Drilling—The Australian Experience*," 10 pages, Undated.

Drawings included in CBM well permit issued to CNX stamped Apr. 15, 2004 by the West Virginia Department of Environmental Protection (4 pages).

Website of Mitchell Drilling Contractors, "*Services: Dymaxion—Surface to In–seam*," http://www.mitchell drilling.com/dymaxion.htm, printed as of Jun. 17, 2004, 4 pages.

Website of CH4, "About Natural Gas—Technology," http://www.ch4.com.au/ng_technology.html, printed as of Jun. 17, 2004, 4 pages.

Thomson, et al., "*The Application of Medium Radius Directional Drilling for Coal Bed Methane Extraction*,"Lucas Technical Paper, copyrighted 2003, 11 pages.

U.S. Department of Energy, DE–FC26–01NT41148, "*Enhanced Coal Bed Methane Production and Sequestration of CO2 in Unmineable Coal Seams*" for Consol, Inc., accepted Oct. 1, 2001, 48 pages, including cover page.

U.S. Department of Energy, "Slant Hole Drilling," Mar. 1999, 1 page.

Breant, Pascal, "*Des Puits Branches, Chez Total : les puits multi drains*," Total Exploration Production, Jan. 1999, pp. 1–5.

Notification of Transmittal of the International Search Report or the Declaration (PCT Rule 44.1) (3 pages) and International Search Report (7 pages) re International Application No. PCT/US 03/04771 mailed Jul. 4, 2003.

Notification of Transmittal of the International Search Report or the Declaration (PCT Rule 44.1) (3 pages) and International Search Report (5 pages) re International Application No. PCT/US 03/21891 mailed Nov. 13, 2003.

Desai, Praful, et al., "*Innovation Design Allows Construction of Level 3 or Level 4 Junction Using the Same Platform*," SPE/Petroleum Society of CIM/CHOA 78965, Canadian Heavy Oil Association, 2002, pp. 1–11.

Bybee, Karen, "*Advanced Openhole Multilaterals*," Horizontal Wells, Nov. 2002, pp. 41–42.

Bybee, Karen, "*A New Generation Multilateral System for the Troll Olje Field*," Multilateral/Extended Reach, Jul. 2002, pp. 50–51.

Emerson,, A.B., et al., "*Moving Toward Simpler, Highly Functional Multilateral Completions*," Technical Note, Journal of Canadian Petroleum Technology, May 2002, vol. 41, No. 5, pp. 9–12.

Moritis, Guntis, "*Complex Well Geometries Boost Orinoco Heavy Oil Producing Rates*," XP–000969491, Oil & Gas Journal, Feb. 28, 2000, pp. 42–46.

Themig, Dan, "*Multilateral Thinking*," New Technology Magazine, Dec. 1999, pp. 24–25.

Smith, R.C., et al., "*The Lateral Tie–Back System: The Ability to Drill and Case Multiple Laterals*," IADC/SPE 27436, Society of Petroleum Engineers, 1994, pp. 55–64, plus Multilateral Services Profile (1 page) and Multilateral Services Specifications (1 page).

Notification of Transmittal of the International Search Report or the Declaration (PCT Rule 44.1) (3 pages) and International Search Report (4 pages) re International Application No. PCT/US 03/13954 mailed Sep. 1, 2003.

Logan, Terry L., "*Drilling Techniques for Coalbed Methane*," Hydrocarbons From Coal, Chapter 12, Cover Page, Copyright Page, pp. 269–285, Copyright 1993.

Hanes, John, "*Outbursts in Leichhardt Colliery: Lessons Learned*," International Symposium–Cum–Workshop on Management and Control of High Gas Emissions and Outbursts in Underground Coal Mines, Wollongong, NSW, Australia, Mar. 20–24, 1995, Cover page, pp. 445–449.

Williams, Ray, et al., "*Gas Reservoir Properties for Mine Gas Emission Assessment*," Bowen Basin Symposium 2000, pp. 325–333.

Brown, K., et al., "*New South Wales Coal Seam Methane Potential*," Petroleum Bulletin 2, Department of Mineral Resources, Discovery 2000, Mar. 1996, pp. i–viii, 1–96.

PowerPoint Presentation entitled, "Horizontal Coalbed Methane Wells," by Bob Stayton, Computalog Drilling Services, date is believed to have been in 2002 (39 pages).

Denney, Dennis, "*Drilling Maximum–Reservoir–Contact Wells in the Shaybah Field*," SPE 85307, pp. 60, 62–63, Oct. 20, 2003.

Fipke, S., et al., "*Economical Multilateral Well Technology for Canadian Heavy Oil*," Petroleum Society, Canadian Institute of Mining, Metallurgy & Petroleum, Paper 2002–100, to be presented in Calgary Alberta, Jun. 11–13, 2002, pp. 1–11.

Notification of Transmittal of the International Search Report or the Declaration (PCT Rule 44.1) mailed Dec. 19, 2003 (6 pages) re International Application No. PCT/US 03/28137.

Notification of Transmittal of the International Search Report or the Declaration (PCT Rule 44.1) mailed Feb. 4, 2004 (8 pages) re International Application No. PCT/US 03/26124.

Smith, Maurice, "*Chasing Unconventional Gas Unconventionally*," CBM Gas Technology, New Technology Magazine, Oct./Nov. 2003, pp. 1–4.

Gardes, Robert "*A New Direction in Coalbed Methane and Shale Gas Recovery*," (to the best of Applicants' recollection, first received at The Canadian Institute Coalbed Methane Symposium conference on Jun. 16 and Jun. 17, 2002), 1 page of conference flyer, 6 pages of document.

Gardes, Robert, "*Under–Balance Multi–Lateral Drilling for Uncoventional Gas Recovery*," (to the best of Applicants' recollection, first received at The Unconventional Gas Revolution conference on Dec. 9, 2003), 4 pages of conference flyer, 33 pages of document.

Boyce, Richard "*High Resolution Selsmic Imaging Programs for Coalbed Methane Development*," (to the best of Applicants' recollection, first received at The Unconventional Gas Revolution conference on Dec. 10, 2003), 4 pages of conference flyer, 24 pages of document.

Mark Mazzella and David Strickland, "*Well Control Operations on a Multiwell Platform Blowout*," WorldOil.com—Online Magazine Article, vol. 22, Part I—pp. 1–7, and Part II—pp. 1–13, Jan. 2002.

Vector Magnetics LLC, Case History, California, May 1999, "*Successful Kill of a Surface Blowout*," pp. 1–12.

Cudd Pressure Control, Inc, "*Successful Well Control Operations–A Case Study: Surface and Subsurface Well Intervention on a Multi–Well Offshore Platform Blowout and Fire*," pp. 1–17, http://www.cuddwellcontrol.com/literature/successful/successful_well.htm, 2000.

R. Purl, et al., "*Damage to Coal Permeability During Hydraulic Fracturing*," pp. 109–115 (SPE 21813), 1991.

U.S. Dept. of Energy—Office of Fossil Energy, "*Multi–Seam Well Completion Technology: Implications for Powder River Basin Coalbed Methane Production*," pp. 1–100, A–1 through A10, Sep. 2003.

U.S. Dept. of Energy—Office of Fossil Energy, "*Powder River Basin Coalbed Methane Development and Produced Water Management Study*," pp. 1–111, A–1 through A14, Sep. 2003.

Notification of Transmittal of the International Search Report or the Declaration (PCT Rule 44.1) mailed Feb. 9, 2004 (6 pages) re International Application No. PCT/US 03/28138, Sep. 9, 2003.

Notification of Transmittal of the International Search Report or the declaration (PCT Rule 44.1) mailed Feb. 27, 2004 (9 pages) re International Application No. PCT/US 03/30126, Feb. 23, 2003.

Fletcher, "Anadarko Cuts Gas Route Under Canadian River Gorge," Oil and Gas Journal, pp. 28–30, Jan. 25, 2004.

Translation of selected pages of Kalinin, et al., "Drilling Inclined and Horizontal Well Bores," Nedra Publishers, Moscow, 1997, 15 pages, 1997.

Translation of selected pages of Arens, V.Zh., "Well–Drilling Recovery of Minerals," Geotechnology, Nedra Publishers, Moscow, 7 pages, 1986.

Notification of Transmittal of the International Search Report or the Declaration (PCT Rule 44.1) mailed Nov. 6, 2003 (8 pages) re International Application No. PCT/US 03/21626.

Notification of Transmittal of the International Search Report or the Declaration (PCT Rule 44.1) mailed Nov. 5, 2003 (8 pages) re International Application No. PCT/US 03/21627.

Notification of Transmittal of the International Search Report or the Declaration (PCT Rule 44.1) mailed Nov. 4, 2003 (7 pages) re International Application No. PCT/US 03/21628.

Notification of Transmittal of the International Search Report or the Declaration (PCT Rule 44.1) mailed Dec. 5, 2003 (8 pages) re International Application No. PCT/US 03/21750.

Examiner of Record, Office Action Response regarding the Interpretation of the three Russian Patent Applications listed above under Foreign Patent Documents (9 pages), Date Unknown.

B. Gotas et al., "*Performance of Openhole Completed and Cased Horizontal/Undulating Wells in Thin–Bedded, Tight Sand Gas Reservoirs*," Society of Petroleum Engineers, Inc., Oct. 17 through Oct. 19, 2000, pp. 1–7.

R. Sharma, et al., "*Modelling of Undulating Wellbore Trajectories, The Journal of Canadian Petroleum Technology*", XP–002261908, Oct. 18–20, 1993, pp. 16–24, Oct. 18, 2000–Oct. 20, 2000.

E. F. Balbinski et al., "*Prediction of Offshore Viscous Oil Field Performance*," European Symposium on Improved Oil Recovery, Aug. 18–20, 1999, pp. 1–10, Aug. 20, 2002.

McCray and Cole, "Oil Well Drilling and Technology," *University of Oklahoma Press*, pp 315–319, 1959.

Berger and Anderson, "Modern Petroleum;" *PennWell Books*, pp 106–108, 1878.

Howard L. Hartman, et al.; "SME Mining Engineering Handbook;" *Society for Mining, Metallurgy, and Exploration, Inc.*; pp 1946–1950, 2nd Edition, vol. 2, 1992.

Dave Hassan, Mike Chernichen, Earl Jensen, and Morley Frank; "Multi–lateral technique lowers drilling costs, provides environmental benefits", *Drilling Technology*, pp. 41–47, Oct. 1999.

Gopal Ramaswamy, "Production History Provides CBM Insights," *Oil & Gas Journal*, pp. 49, 50 and 52, Apr. 2, 2001.

Arfon H. Jones et al., A Review of the Physical and Mechanical Properties of Coal with Implications for Coal–Bed Methane Well Completion and Production, *Rocky Mountain Association of Geologists*, pp. 169–181, 1988.

Joseph C. Stevens, Horizontal Applications For Coal Bed Methane Recovery, *Strategic Research Institute*, pp. 1–10 (slides), Mar. 25, 2002.

Weiguo Chi and Luwu Yang, "Feasibility of Coalbed Methane Exploitation in China," *Horizontal Well Technology*, p. 74, Sep. 2001.
Nackerud Product Description, *Harvest Tool Company,LLC*, 1 page, Received Sep. 27, 2001.
Gopal Ramaswamy, "Advances Key For Coalbed Methane," *The American Oil & Gas Reporter*, pp. 71 & 73, Oct. 2001.
R.J. "Bob" Stayton, "Horizontal Wells Boost CBM Recovery", Special Report: Horizontal & Directional Drilling, *The American Oil & Gas Reporter*, pp. 71–75, Aug. 2002.
U.S. Appl. No. 09/769,098, entitled "Method and System for Enhanced Access to a Subterranean Zone," filed Jan. 24, 2001, 65 pages.
U.S. Appl. No. 09/774,996, entitled "Method and System for Accessing a Subterranean Zone From a Limited Surface Area," filed Jan. 30, 2001, 67 pages.
U.S. Appl. No. 09/788,897, entitled "Method and System for Accessing Subterranean Deposits From The Surface," filed Feb. 20, 2001, 54 pages.
U.S. Appl. No. 10/142,817, entitled "Method and System for Underground Treatment of Materials," filed May 8, 2002, 54 pgs.
U.S. Appl. No. 09/885,219, entitled "Method and System for Accessing Subterranean Deposits From The Surface," filed Jun. 20, 2001, 52 pages.
U.S. Appl. No. 10/046,001, entitled "Method and System for Management of By–Products From Subterranean Zones," filed Oct. 19, 2001, 42 pages.
U.S. Appl. No. 10/004,316, entitled "Slant Entry Well System and Method," filed Oct. 30, 2001, 35 pages.
U.S. Appl. No. 10/123,561, entitled "Method and System for Accessing Subterranean Zones From a Limited Surface," filed Apr. 5, 2002, 49 pages.
U.S. Appl. No. 10/123,556, entitled "Method and System for Accessing Subterranean Zones From a Limited Surface," filed Apr. 5, 2002, 49 pages.
U.S. Appl. No. 10/165,627, entitled "Method and System for Accessing Subterranean Deposits from the Surface," filed Jun. 7, 2002, 26 pages.
U.S. Appl. No. 10/165,625, entitled "Method and System for Accessing Subterranean Deposits from the Surface," filed Jun. 7, 2002, 26 pages.
Pend Pat App, Joseph A. Zupanick, "*Method and System for Accessing a Subterranean Zone From a Limited Surface*," U.S. Appl. No. 10/188,141 filed Jul. 1, 2002.
Pend Pat App, Joseph A. Zupanick, "*Undulating Well Bore*," U.S. Appl. 10/194,366, filed Jul. 12, 2002.
Pend Pat App, Joseph A. Zupanick, "*Ramping Well Bores*," U.S. Appl. No. 10/194,367, filed Jul. 12, 2002.
Pend Pat App, Joseph A. Zupanick, "*Wellbore Sealing System and Method*," U.S. Appl. No. 10/194,.368, filed Jul. 12, 2002.
Pend Pat App, Joseph A. Zupanick, "*Wellbore Plug System and Method*," U.S. Appl. No. 10/194,422, filed Jul. 12, 2002.
Pend Pat App, Joseph A. Zupanick, "*System and Method for Subterranean Access*" U.S. Appl. No. 10/227,057, filed Aug. 22, 2002.
Pend Pat App, Joseph A. Zupanick et al., *Method and System for Controlling Pressure in a Dual Well System*, Sep. 12, 2002.

THREE-DIMENSIONAL WELL SYSTEM FOR ACCESSING SUBTERRANEAN ZONES

BACKGROUND OF THE INVENTION

Subterranean deposits of coal often contain substantial quantities of entrained methane gas. Limited production and use of methane gas from coal deposits has occurred for many years. Substantial obstacles, however, have frustrated more extensive development and use of methane gas deposits in coal seams. The foremost problem in producing methane gas from coal seams is that while coal seams may extend over large areas of up to several thousand acres, the coal seams are not very thick, varying from a few inches to several meters thick. Thus, while the coal seams are often relatively near the surface, vertical wells drilled into the coal deposits for obtaining methane gas can only drain a fairly small radius around the coal deposits. Further, coal deposits may not be amenable to pressure fracturing and other methods often used for increasing methane gas production from rock formations. As a result, once the gas easily drained from a vertical well in a coal seam is produced, further production is limited in volume. Additionally, coal seams are often associated with subterranean water, which typically must be drained from the coal seam in order to produce the methane.

SUMMARY OF THE INVENTION

The present invention provides a three-dimensional well system for accessing subterranean zones that substantially eliminates or reduces the disadvantages and problems associated with previous systems and methods. In particular, certain embodiments of the present invention provide a three-dimensional well system for accessing subterranean zones for efficiently producing and removing entrained methane gas and water from multiple coal seams.

In accordance with one embodiment of the present invention, a drainage system for accessing multiple subterranean zones from the surface includes an entry well extending from the surface. The system also includes two or more exterior drainage wells extending from the entry well through the subterranean zones. The exterior drainage wells each extend outwardly and downwardly from the entry well for a first selected distance and then extend downwardly in a substantially vertical orientation for a second selected distance.

Embodiments of the present invention may provide one or more technical advantages. These technical advantages may include providing a system and method for efficiently accessing one or more subterranean zones from the surface. Such embodiments provide for uniform drainage of fluids or other materials from these subterranean zones using a single surface well. Furthermore, embodiments of the present invention may be useful for extracting fluids from multiple thin sub-surface layers (whose thickness makes formation of a horizontal drainage well and/or pattern in the layers inefficient or impossible). Fluids may also be injected into one or more subterranean zones using embodiments of the present invention.

Other technical advantages of the present invention will be readily apparent to one skilled in the art from the figures, descriptions, and claims included herein.

BRIEF DESCRIPTION OF THE DRAWINGS

For a more complete understanding of the present invention and its advantages, reference is now made to the following description taken in conjunction with the accompanying drawings, wherein like numerals represent like parts, in which.

DETAILED DESCRIPTION OF THE INVENTION

Figure 1:
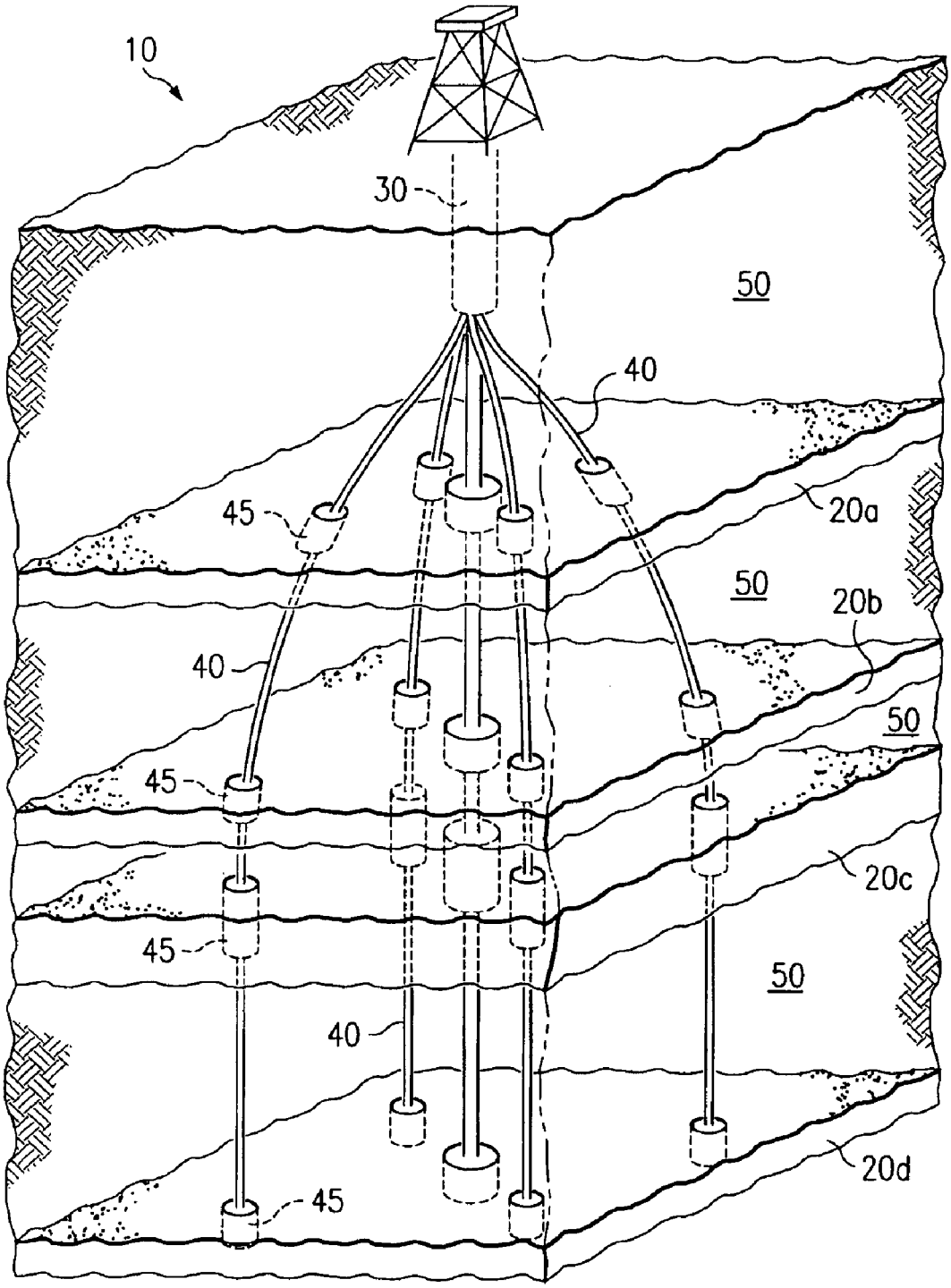
FIG. 1 illustrates an example three-dimensional drainage system in accordance with one embodiment of the present invention.

FIG. 1 illustrates an example three-dimensional drainage system 10 for accessing multiple subterranean zones 20*a*–20*d* (hereinafter collectively referred to as subterranean zones 20) from the surface. In the embodiment described below, subterranean zones 20 are coal seams; however, it will be understood that other subterranean formations can be similarly accessed using drainage system 10. Furthermore, although drainage system 10 is described as being used to remove and/or produce water, hydrocarbons and other fluids from zones 20, system 10 may also be used to treat minerals in zones 20 prior to mining operations, to inject or introduce fluids, gases, or other substances into zones 20, or for any other suitable purposes.

Drainage system 10 includes an entry well 30 and multiple drainage wells 40. Entry well 30 extends from a surface towards subterranean zones 20, and drainage wells 40 extend from near the terminus of entry well 30 through one or more of the subterranean zones 20. Drainage wells 40 may alternatively extend from any other suitable portion of entry well 30 or may extend directly from the surface. Entry well 30 is illustrated as being substantially vertical; however, it should be understood that entry well 30 may be formed at any suitable angle relative to the surface.

One or more of the drainage wells 40 extend outwardly and downwardly from entry well 30 to form a three-dimensional drainage pattern that may be used to extract fluids from subterranean zones 20. Although the term "drainage well" is used, it should also be understood that these wells 40 may also be used to inject fluids into subterranean zones 20. One or more "exterior" drainage wells 40 are initially drilled at an angle away from entry well 30 (or the surface) to obtain a desired spacing of wells 40 for efficient drainage of fluids from zones 20. For example, wells 40 may be spaced apart from one another such that they are uniformly spaced. After extending at an angle away from entry well 30 to obtain the desired spacing, wells 40 may extend substantially downward to a desired depth. A "central" drainage well 40 may also extend directly downwardly from entry well 30. Wells 40 may pass through zones 20 at any appropriate points along the length of each well 40.

As is illustrated in the example system 10 of FIG. 1, each well 40 extends downward from the surface and through multiple subterranean zones 20. In particular embodiments, zones 20 contain fluids under pressure, and these fluids tend to flow from their respective zone 20 into a well 40 passing through such a zone 20. A fluid may then flow down a well 40 and collect at the bottom of the well 40. The fluid may then be pumped to the surface. In addition or alternatively, depending on the type of fluid and the pressure in the formation, a fluid may flow from a zone 20 to a well 40, and then upwardly to the surface. For example, coal seams 20 containing water and methane gas may be drained using wells 40. In such a case, the water may drain from a coal seam 20 and flow to the bottom of wells 40 and be pumped to the surface. While this water is being pumped, methane gas may flow from the coal seam 20 into wells 40 and then upwardly to the surface. As is the case with many coal seams, once a sufficient amount of water has been drained from a coal seam 20, the amount of methane gas flowing to the surface may increase significantly.

In certain types of subterranean zones 20, such as a zones 20 having low permeability, fluid is only able to effectively travel a short distance to a well 40. For example, in a low permeability coal seam 20, it may take a long period of time for water in the coal seam 20 to travel through the seam 20 to a single well drilled into the coal seam 20 from the surface. Therefore, it may also take a long time for the seam 20 to be sufficiently drained of water to produce methane gas efficiently (or such production may never happen). Therefore, it is desirable to drill multiple wells into a coal seam 20, so that water or other fluids in a particular portion of a coal seam or other zone 20 are relatively near to at least one well. In the past, this has meant drilling multiple vertical wells that each extend from a different surface location; however, this is generally an expensive and environmentally unfriendly process. System 10 eliminates the need to drill multiple wells from the surface, while still providing uniform access to zones 20 using multiple drainage wells 40. Furthermore, system 10 provides more uniform coverage and more efficient extraction (or injection) of fluids than hydraulic fracturing, which has been used with limited success in the past to increase the drainage area of a well bore.

Typically, the greater the surface area of a well 40 that comes in contact with a zone 20, the greater the ability of fluids to flow from the zone 20 into the well 40. One way to increase the surface area of each well 40 that is drilled into and/or through a zone 20 is to create an enlarged cavity 45 from the well 40 in contact with the zone 20. By increasing this surface area, the number of gas-conveying cleats or other fluid-conveying structures in a zone 20 that are intersected by a well 40 is increased. Therefore, each well 40 may have one or more associated cavities 45 at or near the intersection of the well 40 with a subterranean zone 20. Cavities 45 may be created using an underreaming tool or using any other suitable techniques.

In the example system 10, each well 40 is enlarged to form a cavity 45 where each well 40 intersects a zone 20. However, in other embodiments, some or all of wells 40 may not have cavities at one or more zones 20. For example, in a particular embodiment, a cavity 45 may only be formed at the bottom of each well 40. In such a location, a cavity 45 may also serve as a collection point or sump for fluids, such as water, which have drained down a well 40 from zones 20 located above the cavity 45. In such embodiments, a pump inlet may be positioned in the cavity 45 at the bottom of each well 40 to collect the accumulated fluids. As an example only, a Moyno pump may be used.

In addition to or instead of cavities 45, hydraulic fracturing or "fracing" of zones 20 may be used to increase fluid flow from zones 20 into wells 40. Hydraulic fracturing is used to create small cracks in a subsurface geologic formation, such as a subterranean zone 20, to allow fluids to move through the formation to a well 40.

As described above, system 10 may be used to extract fluids from multiple subterranean zones 20. These subterranean zones 20 may be separated by one or more layers 50 of materials that do not include hydrocarbons or other materials that are desired to be extracted and/or that prevent the flow of such hydrocarbons or other materials between subterranean zones 20. Therefore, it is often necessary to drill a well to (or through) a subterranean zone 20 in order to extract fluids from that zone 20. As described above, this may be done using multiple vertical surface wells. However, as described above, this requires extensive surface operations.

The extraction of fluids may also be performed using a horizontal well and/or drainage pattern drilled through a zone 20 and connected to a surface well to extract the fluids collected in the horizontal well and/or drainage pattern. However, although such a drainage pattern can be very effective, it is expensive to drill. Therefore, it may not be economical or possible to drill such a pattern in each of multiple subterranean zones 20, especially when zones 20 are relatively thin.

System 10, on the other hand, only requires a single surface location and can be used to economically extract fluids from multiple zones 20, even when those zones 20 are relatively thin. For example, although some coal formations may comprise a substantially solid layer of coal that is fifty to one hundred feet thick (and which might be good candidates for a horizontal drainage pattern), other coal formations may be made up of many thin (such as a foot thick) layers or seams of coal spaced apart from one another. While it may not be economical to drill a horizontal drainage pattern in each of these thin layers, system 10 provides an efficient way to extract fluids from these layers. Although system 10 may not have the same amount of well surface area contact with a particular coal seam 20 as a horizontal drainage pattern, the use of multiple wells 40 drilled to or through a particular seam 20 (and possibly the use of cavities 45) provides sufficient contact with a seam 20 to enable sufficient extraction of fluid. Furthermore, it should be noted that system 10 may also be effective to extract fluids from thicker coal seams or other zones 20 as well.

Figure 2:
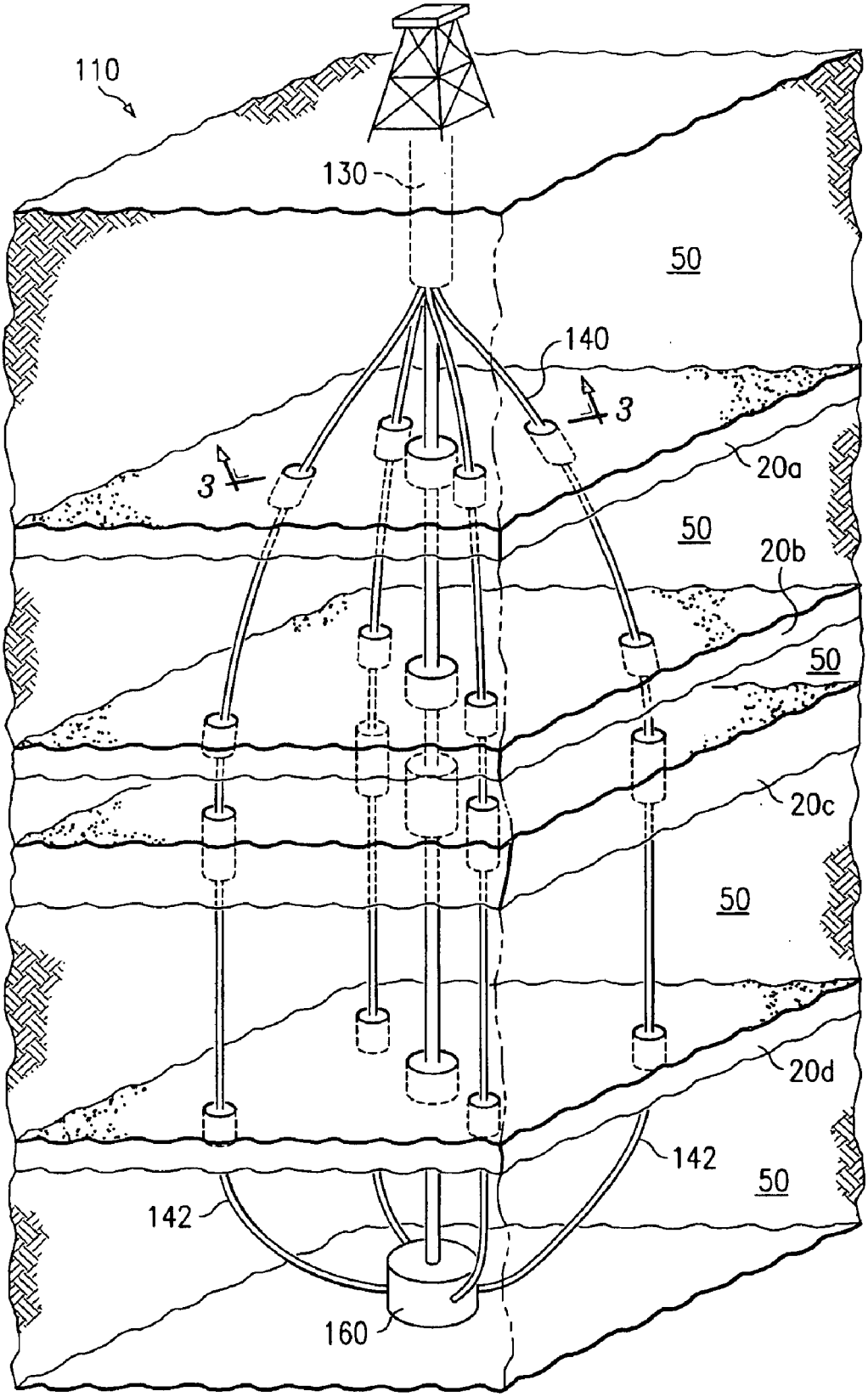
FIG. 2 illustrates an example three-dimensional drainage system in accordance with another embodiment of the present invention.

FIG. 2 illustrates another example three-dimensional drainage system 110 for accessing multiple subterranean zones 20 from the surface. System 110 is similar to system 10 described above in conjunction with FIG. 1. Thus, system 110 includes an entry well 130, drainage wells 140 formed through subterranean zones 20, and cavities 145. However, unlike system 10, the exterior drainage wells 140 of system 110 do not terminate individually (like wells 40), but instead have a lower portion 142 that extends toward the central drainage well 140 and intersects a sump cavity 160 located in or below the deepest subterranean zone 20 being accessed. Therefore, fluids draining from zones 20 will drain to a common point for pumping to the surface. Thus, fluids only need to be pumped from sump cavity 160, instead of from the bottom of each drainage well 40 of system 10. Sump cavity 160 may be created using an underreaming tool or using any other suitable techniques.

Figure 3:
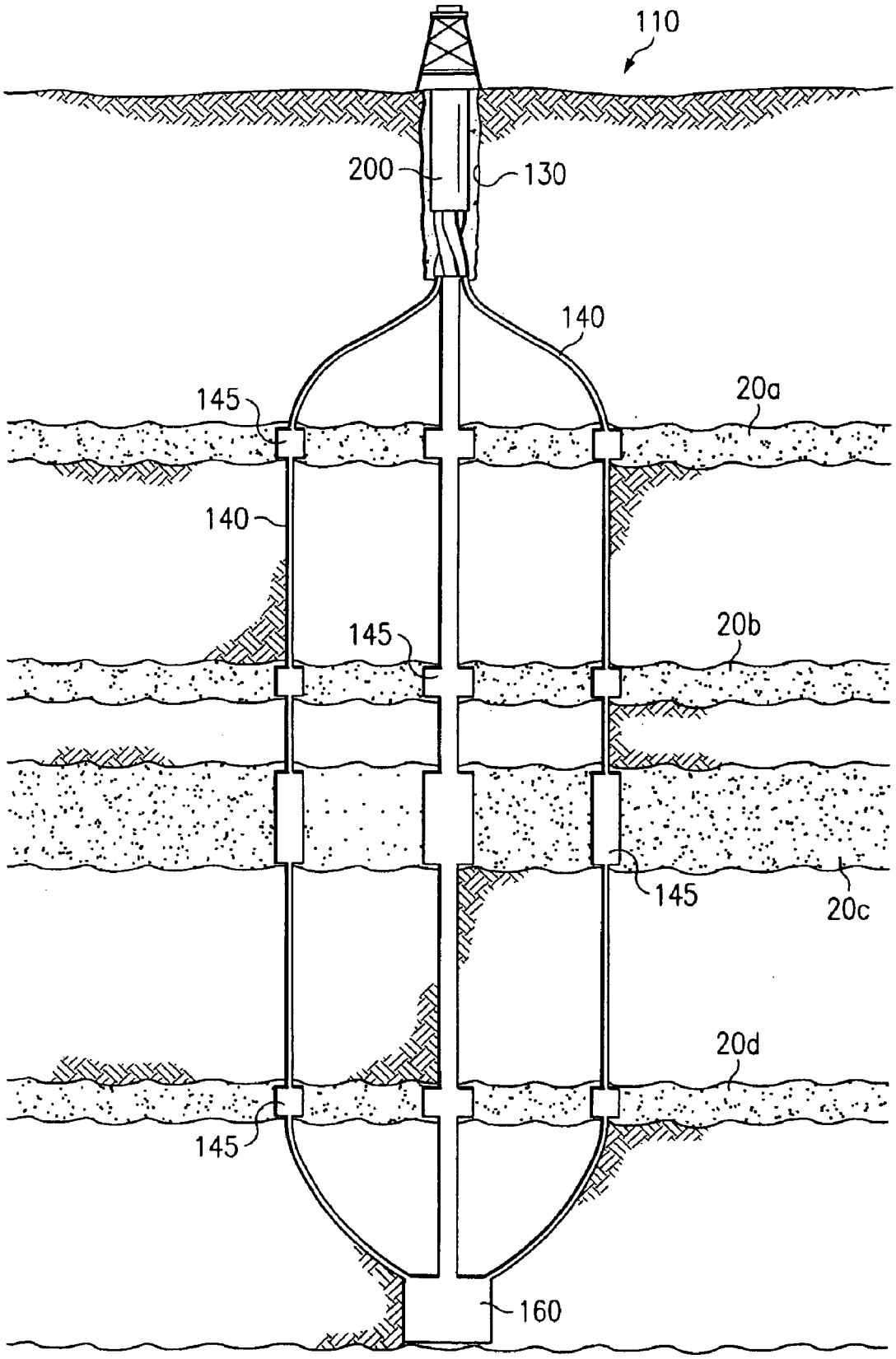
FIG. 3 illustrates a cross-section diagram of the example three-dimensional drainage system of FIG. 2.

FIG. 3 illustrates a cross-section diagram of example three-dimensional drainage system 110, taken along line 3—3 as indicated in FIG. 2. This figure illustrates in further detail the intersection of drainage wells 140 with sump cavity 160. Furthermore, this figure illustrates a guide tube bundle 200 that may be used to aid in the drilling of drainage wells 140 (or drainage wells 40), as described below.

Figure 4:
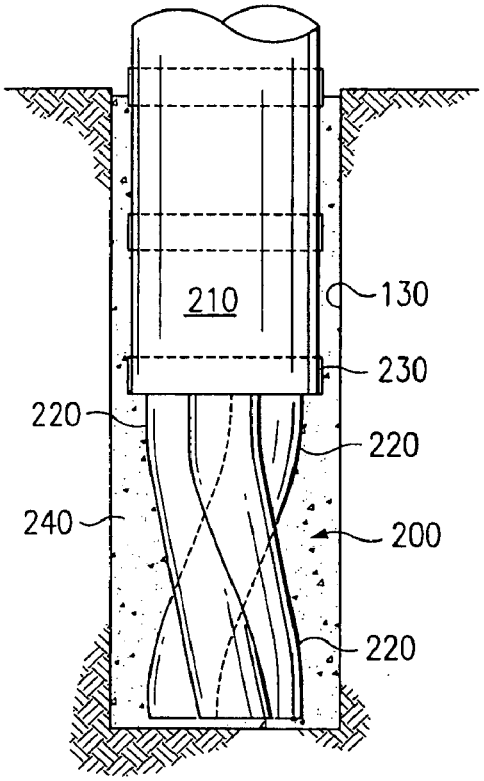
FIG. 4 illustrates an entry well and an installed guide tube bundle.

FIG. 4 illustrates entry well 130 with a guide tube bundle 200 and an associated casing 210 installed in entry well 130. Guide tube bundle 200 may be positioned near the bottom of entry well 130 and used to direct a drill string in one of several particular orientations for the drilling of drainage wells 140. Guide tube bundle 200 comprises a set of twisted guide tubes 220 (which may be joint casings) and a casing collar 230, as illustrated, and is attached to casing 210. As described below, the twisting of joint casings 220 may be used to guide a drill string to a desired orientation. Although three guide tubes 220 are shown in the example embodiment, any appropriate number may be used. In particular embodiments, there is one guide tube 220 that corresponds to each drainage well 40 to be drilled.

Casing 210 may be any fresh water casing or other casing suitable for use in down-hole operations. Casing 210 and guide tube bundle 200 are inserted into entry well 130, and a cement retainer 240 is poured or otherwise installed around the casing inside entry well 130. Cement retainer 240 may be any mixture or substance otherwise suitable to maintain casing 210 in the desired position with respect to entry well 130.

Figure 5:
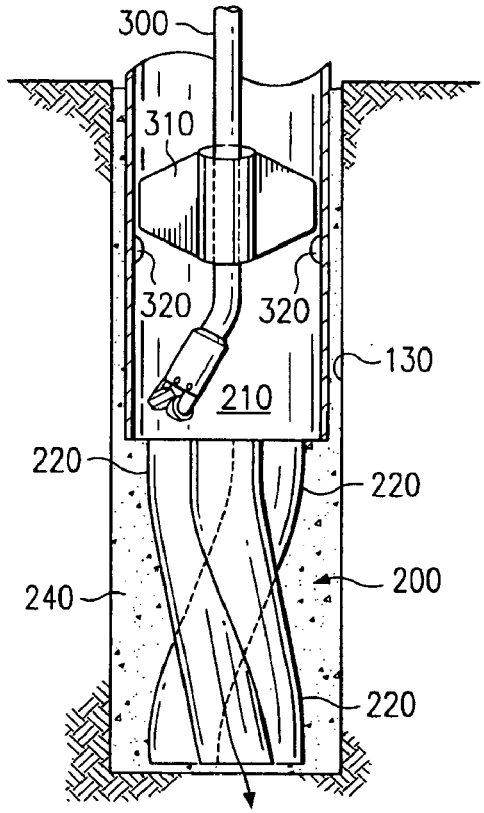
FIG. 5 illustrates an entry well and an installed guide tube bundle as drainage wells are about to be drilled.

FIG. 5 illustrates entry well 130 and guide tube bundle 200 as drainage wells 140 are about to be drilled. A drill string 300 is positioned to enter one of the guide tubes 220 of guide tube bundle 200. Drill string 300 may be successively directed into each guide tube 220 to drill a corresponding drainage well 40 from each guide tube 220. In order to keep drill string 300 relatively centered in entry well 130, a stabilizer 310 may be employed. Stabilizer 310 may be a ring and fin type stabilizer or any other stabilizer suitable to keep drill string 300 relatively centered. To keep stabilizer 310 at a desired depth in entry well 130, a stop ring 320 may be employed. Stop ring 320 may be constructed of rubber, metal, or any other suitable material. Drill string 300 may be inserted randomly into any of a plurality of guide tubes 220, or drill string 300 may be directed into a selected guide tube 220.

Figure 6:
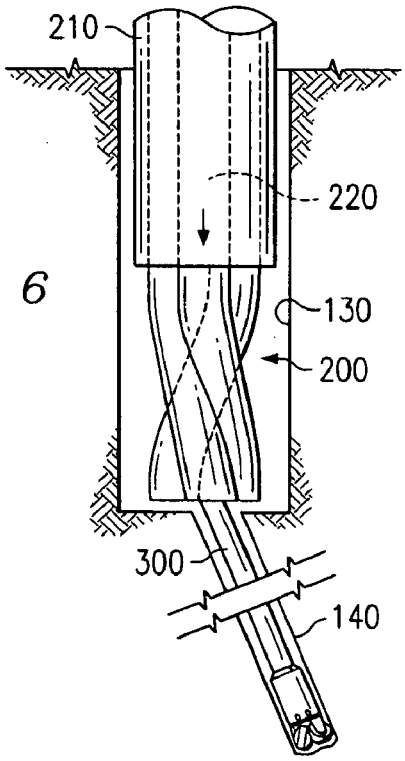
FIG. 6 illustrates an entry well and an installed guide tube bundle as a drainage well is being drilled.

FIG. 6 illustrates entry well 130 and guide tube bundle 200 as a drainage well 140 is being drilled. As is illustrated, the end of each guide tube 220 is oriented such that a drill string 300 inserted in the guide tube 220 will be directed by the guide tube in a direction off the vertical. This direction of orientation for each tube 220 may be configured to be the desired initial direction of each drainage well 140 from entry well 130. Once each drainage well 140 has been drilled a sufficient distance from entry well 130 in the direction dictated by the guide tube 220, directional drilling techniques may then be used to change the direction of each drainage well 140 to a substantially vertical direction or any other desired direction.

Figure 7:
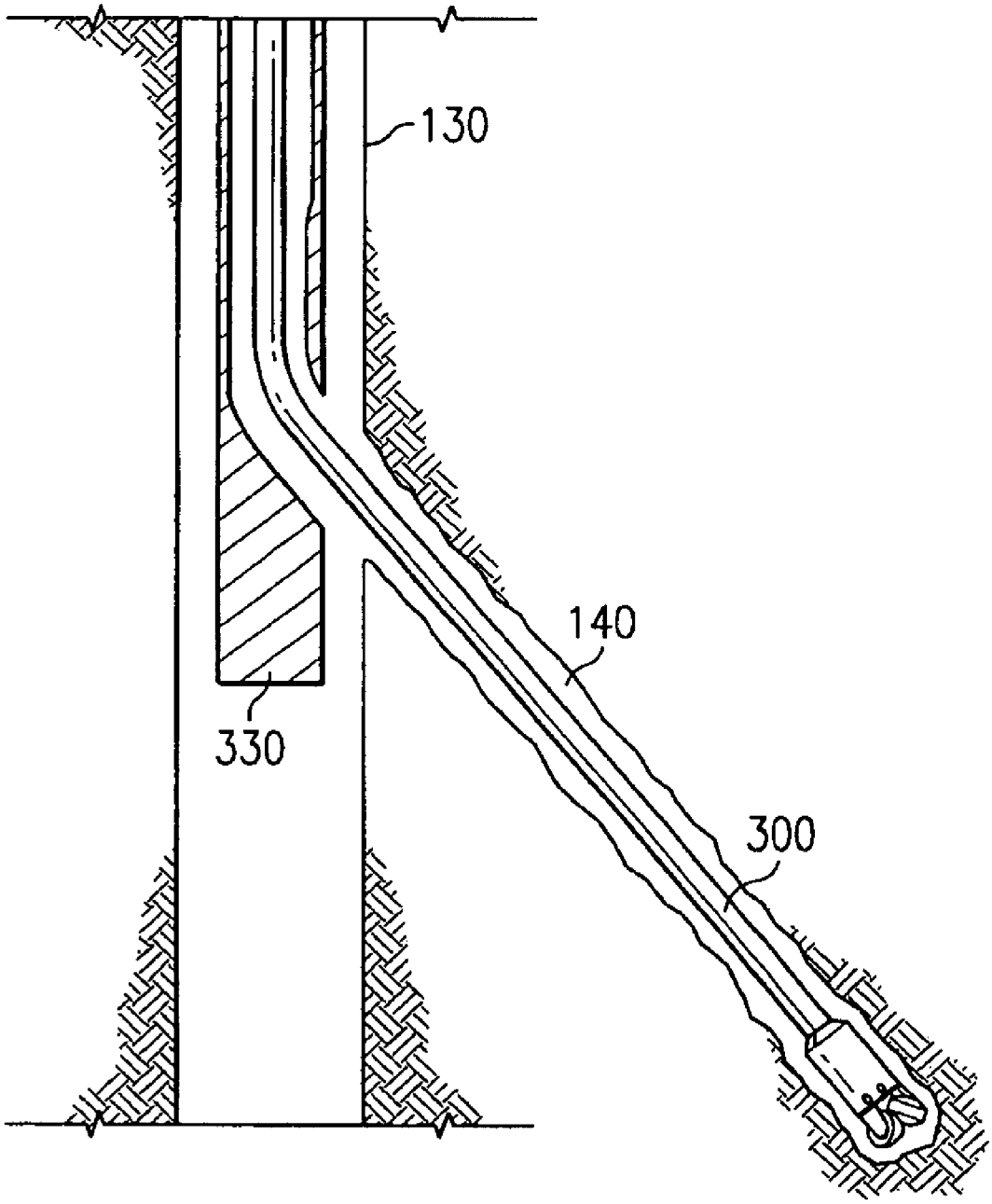
FIG. 7 illustrates the drilling of a drainage well from an entry well using a whipstock.

It should be noted that although the use of a guide tube bundle 200 is described, this is merely an example and any suitable technique may be used to drill drainage wells 140 (or drainage wells 40). For example, a whipstock may alternatively be used to drill each drainage well 140 from entry well 130, and such a technique is included within the scope of the present invention. If a whipstock is used, entry well 130 may be of a smaller diameter than illustrated since a guide tube bundle does not need to be accommodated in entry well 130. FIG. 7 illustrates the drilling of a first drainage well 140 from entry well 130 using a drill string 300 and a whipstock 330.

Figure 8:
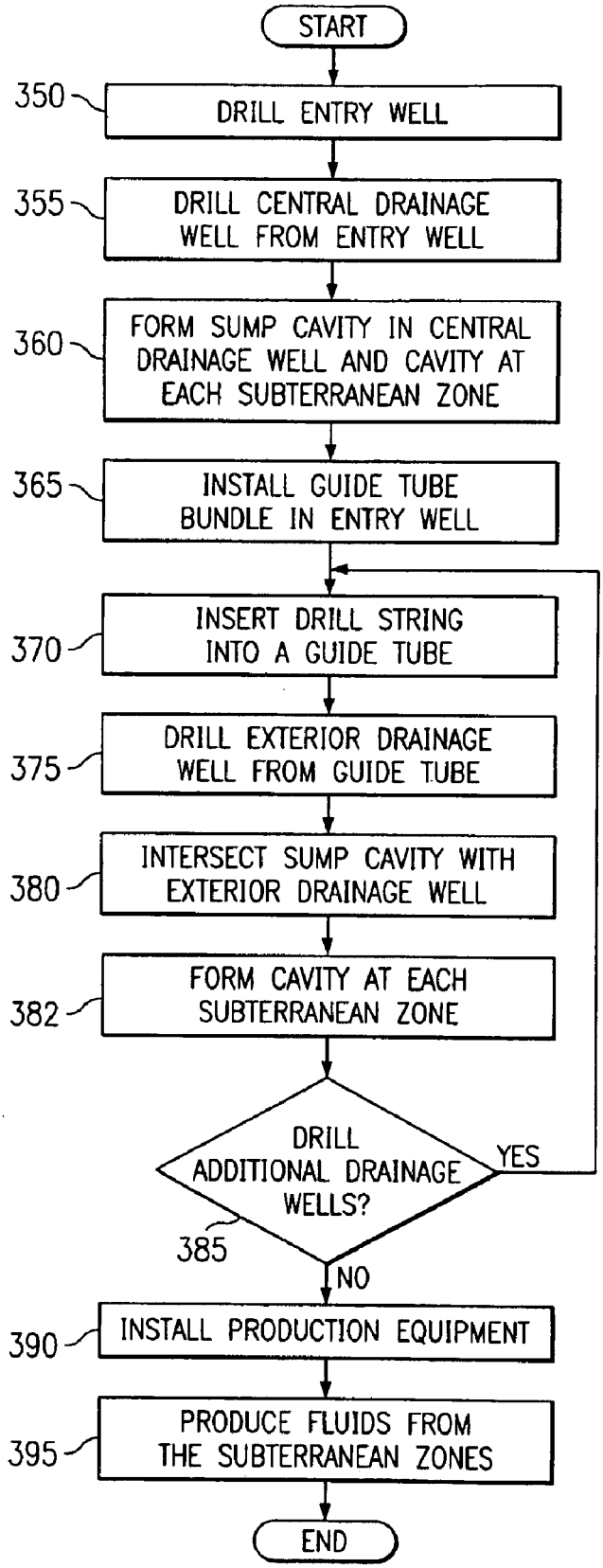
FIG. 8 illustrates an example method of drilling and producing from an example three-dimensional drainage system.

FIG. 8 illustrates an example method of drilling and producing fluids or other resources using three-dimensional drainage system 110. The method begins at step 350 where entry well 130 is drilled. At step 355, a central drainage well 140 is drilled downward from entry well 130 using a drill string. At step 360, a sump cavity 160 is formed near the bottom of central drainage well 140 and a cavity 145 is formed at the intersection of central drainage well 140 and each subterranean zone 20. At step 365, a guide tube bundle 200 is installed into entry well 130.

At step 370, a drill string 300 is inserted through entry well 130 and one of the guide tubes 220 in the guide tube bundle 200. The drill string 300 is then used to drill an exterior drainage well 140 at step 375 (note that the exterior drainage well 140 may have a different diameter than central drainage well 140). As described above, once the exterior drainage well 140 has been drilled an appropriate distance from entry well 130, drill string 130 may be maneuvered to drill drainage well 140 downward in a substantially vertical orientation through one or more subterranean zones 20 (although well 140 may pass through one or more subterranean zones 20 while non-vertical). Furthermore, in particular embodiments, wells 140 (or 40) may extend outward at an angle to the vertical. At step 380, drill string 300 is maneuvered such that exterior drainage well 140 turns towards central drainage well 140 and intersects sump cavity 160. Furthermore, a cavity 145 may be formed at the intersection of the exterior drainage well 140 and each subterranean zone 20 at step 382.

At decisional step 385, a determination is made whether additional exterior drainage wells 140 are desired. If additional drainage wells 140 are desired, the process returns to step 370 and repeats through step 380 for each additional drainage well 140. For each drainage well 140, drill string 300 is inserted into a different guide tube 220 so as to orient the drainage well 140 in a different direction than those already drilled. If no additional drainage wells 140 are desired, the process continues to step 390, where production equipment is installed. For example, if fluids are expected to drain from subterranean zones 20 to sump cavity 160, a pump may be installed in sump cavity 160 to raise the fluid to the surface. In addition or alternatively, equipment may be installed to collect gases rising up drainage wells 140 from subterranean zones 20. At step 395, the production equipment is used to produce fluids from subterranean zones 20, and the method ends.

Although the steps have been described in a certain order, it will be understood that they may be performed in any other appropriate order. Furthermore, one or more steps may be omitted, or additional steps performed, as appropriate.

Figure 9:
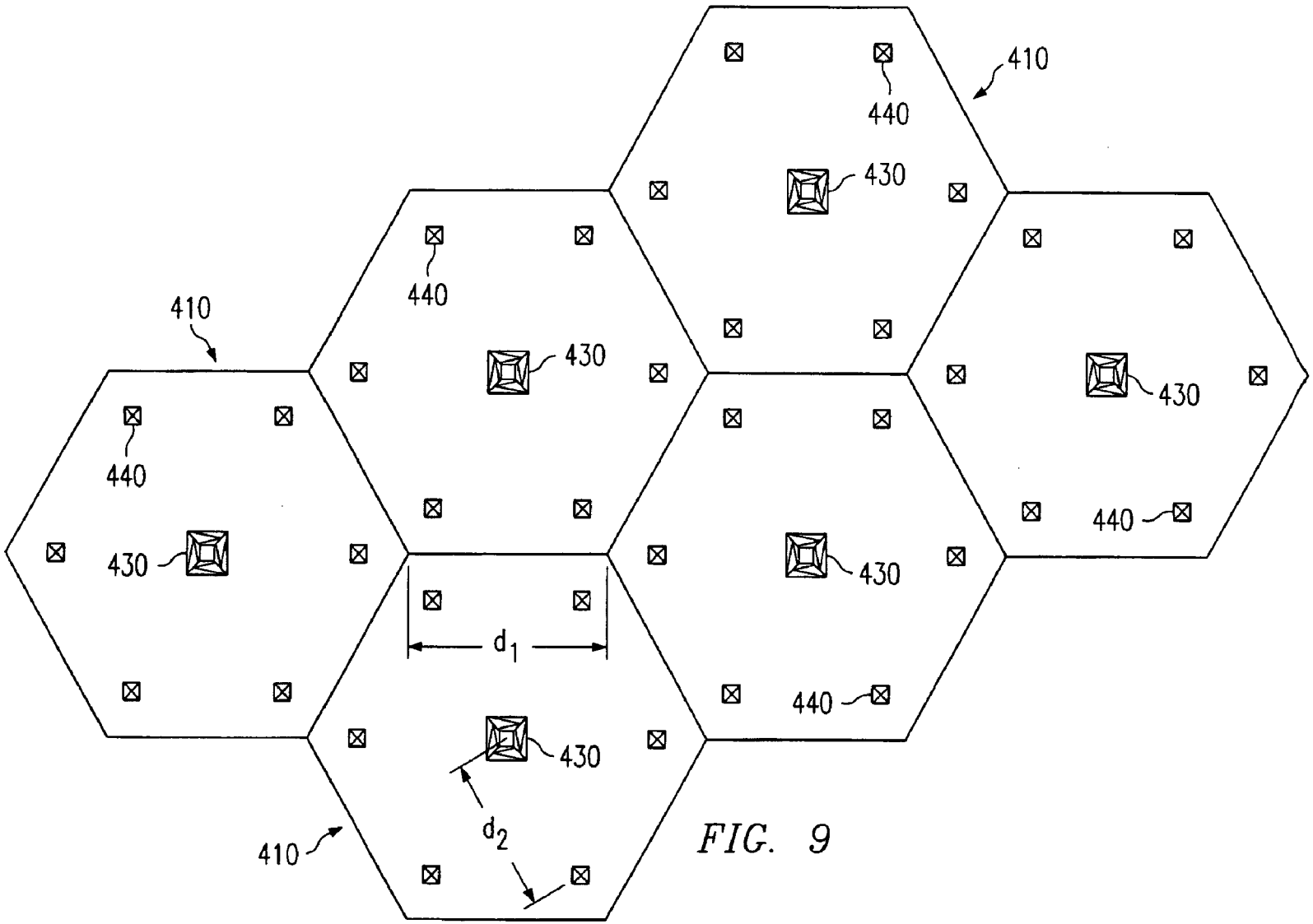
FIG. 9 illustrates a nested configuration of multiple three-dimensional drainage systems.

FIG. 9 illustrates a nested configuration of multiple example three-dimensional drainage systems 410. Each drainage system 410 comprises seven drainage wells 440 arranged in a hexagonal arrangement (with one of the seven wells 440 being a central drainage well 410 drilled directly downward from an entry well 430). Since drainage wells 440 are located subsurface, their outermost portion (that which is substantially vertical) is indicated with an "x" in FIG. 9. As an example only, each system 410 may be formed having a dimension $d_1$ of 1200 feet and a dimension $d_2$ of 800 feet. However, any other suitable dimensions may be used and this is merely an example.

As is illustrated, multiple systems 410 may be positioned in relationship to one another to maximize the drainage area of a subterranean formation covered by systems 410. Due to the number and orientation of drainage wells 440 in each system 410, each system 410 covers a roughly hexagonal drainage area. Accordingly, system 410 may be aligned or "nested", as illustrated, such that systems 410 form a roughly honeycomb-type alignment and provide uniform drainage of a subterranean formation.

Although "hexagonal" systems 410 are illustrated, may other appropriate shapes of three-dimensional drainage systems may be formed and nested. For example, systems 10 and 110 form a square or rectangular shape that may be nested with other systems 10 or 110. Alternatively, any other polygonal shapes may be formed with any suitable number (even or odd) of drainage wells.

Although the present invention has been described with several embodiments, various changes and modifications may be suggested to one skilled in the art. It is intended that the present invention encompass such changes and modifications as fall within the scope of the appended claims.

What is claimed is:

1. A method for accessing a plurality of subterranean zones from the surface, comprising:

forming an entry well from the surface;

forming a central drainage well extending downwardly from the entry well in a substantially vertical orientation through the subterranean zones;

forming an enlarged cavity from the central drainage well and proximate a bottom of the central drainage well; and forming two or more exterior drainage wells from the entry well through the subterranean zones, wherein each exterior drainage well:

extends outwardly and downwardly from the entry well for a first selected distance;

extends downwardly in a substantially vertical orientation for a second selected distance; and extends inwardly towards the central drainage well for a third selected distance and intersects the enlarged cavity.

2. The method of claim 1, further comprising forming an enlarged cavity from one or more of the exterior drainage wells proximate the intersection of the one or more exterior drainage wells and one or more of the subterranean zones.

3. The method of claim 1, wherein the central drainage well comprises a larger diameter than the exterior drainage wells.

4. The method of claim 1, further comprising:

positioning a pump inlet in the enlarged cavity; and pumping fluids produced from one or more of the subterranean zones from the enlarged cavity to the surface.

5. The method of claim 1, further comprising forming a plurality of drainage systems each comprising an entry well and two or more associated exterior drainage wells, the drainage systems located in proximity to one another such that they nest adjacent one another.

6. The method of claim 5, wherein each drainage system comprises six exterior drainage wells and covers a substantially hexagonal area and wherein the drainage systems nest together in a honeycomb pattern.

7. The method of claim 1, wherein the plurality of subterranean zones comprise coal seams.

8. The method of claim 1, further comprising:

positioning a pump inlet proximate a bottom of one or more of the drainage wells; and pumping fluids produced from one or more of the subterranean zones from the pump inlet to the surface.

9. The method of claim 1, further comprising injecting fluids into one or more of the subterranean zones from the surface using the drainage wells.

10. The method of claim 1, further comprising:

inserting a guide tube bundle into the entry well, the guide tube bundle comprising two or more twisted guide tubes; and forming the exterior drainage wells from the entry well using the guide tubes.

11. The method of claim 1, wherein the two or more exterior drainage wells are formed from the entry well using a whipstock.

12. A drainage system for accessing a plurality of subterranean zones from the surface, comprising:

an entry well extending from the surface;

a central drainage well extending downwardly from the entry well in a substantially vertical orientation through the subterranean zones;

an enlarged cavity formed from the central drainage well proximate a bottom of the central drainage well; and two or more exterior drainage wells extending from the entry well through the subterranean zones, wherein each exterior drainage well;

extends outwardly and downwardly from the entry well for a first selected distance;

extends downwardly in a substantially vertical orientation for a second selected distance; and extends inwardly towards the central drainage well for a third selected distance and intersects the enlarged cavity.

13. The system of claim 12, further comprising an enlarged cavity formed from one or more of the exterior drainage wells proximate the intersection of the one or more exterior drainage wells and one or more of the subterranean zones.

14. The system of claim 12, wherein the central drainage well comprises a larger diameter than the exterior drainage wells.

15. The system of claim 12, further comprising a pump configured to pump fluids produced from one or more of the subterranean zones from the enlarged cavity to the surface.

16. The system of claim 12, further comprising a plurality of drainage systems each comprising an entry well and two or more associated exterior drainage wells, the drainage systems located in proximity to one another such that they nest adjacent one another.

17. The system of claim 16, wherein each drainage system comprises six exterior drainage wells and covers a substantially hexagonal area, and wherein the drainage systems nest together in a honeycomb pattern.

18. The system of claim 12, wherein the plurality of subterranean zones comprise coal seams.

19. The system of claim 12, further comprising a pump configured to pump fluids produced from one or more of the subterranean zones from a bottom of one or more of the exterior drainage wells to the surface.

20. The system of claim 12, further comprising a guide tube bundle positioned in the entry well, the guide tube bundle comprising two or more twisted guide tubes, and wherein the exterior drainage wells are formed from the entry well using the guide tubes.

21. A drainage system for accessing one or more subterranean zones from the surface, comprising:

a central drainage well extending from the surface to at least one subterranean zone; and two or more exterior drainage wells extending from the surface and through the at least one subterranean zone, the exterior drainage wells each extending outwardly away from the central drainage well and downwardly;

the two or more exterior drainage wells further extending inwardly towards the central drainage well and intersecting the central drainage well proximate to or below the at least one subterranean zone; and whereby fluids drain from the at least one subterranean zone through the two or more exterior drainage wells to the central drainage well for production to the surface.

22. The system of claim 21, wherein the two or more exterior drainage wells extend from the surface through the central drainage well.

23. The system of claim 21, wherein the central drainage well and the two or ore exterior drainage wells extend from a single surface location.

24. The system of claim 21, wherein the two or more exterior drainage wells extend from the central drainage well at an angle.

25. The system of claim 21, wherein the two or more exterior drainage wells are substantially uniformly spaced from the central drainage well.

26. The system of claim 21, wherein the two or more exterior drainage wells intersect multiple subterranean zones, each of the two or more exterior drainage wells capable of draining fluids from the multiple subterranean zones.

27. The system of claim 21, comprising an enlarged cavity formed from one or more of the exterior drainage wells proximate one or more of the subterranean zones.

28. The system of claim 21, wherein the central drainage well comprises an entry well.

29. The system of claim 21, wherein the central drainage well comprises a substantially vertical central drainage well.

30. The system of claim 21, wherein each exterior drainage well extends substantially vertically downward for a distance.

31. The system of claim 21, comprising three or more exterior drainage wells.

32. The system of claim 21, comprising four or more exterior drainage wells.

33. The system of claim 21, comprising six or more exterior drainage wells.

34. A method for accessing one or more subterranean zones from the surface, comprising:

forming a central drainage well from the surface to at least one subterranean zone;

forming two or more exterior drainage wells from the surface and extending through the at least one subterranean zone, the exterior drainage wells each extending outwardly away from the central drainage well and downwardly, the two or more exterior drainage wells further extending inwardly towards the central drainage well and intersecting the central drainage well proximate to or below the at least one subterranean zone; and draining fluids from the at least one subterranean zone through the two or more exterior drainage wells to the central drainage well for production to the surface.

35. The method of claim 34, further comprising forming the two or more exterior drainage wells from the surface through the central drainage well.

36. The method of claim 34, comprising forming the central drainage well and the two or more exterior drainage wells from a single surface location.

37. The method of claim 34, further comprising forming, at an angle, the two or more exterior drainage wells from the central drainage well.

38. The method of claim 34, comprising forming the two or more exterior drainage wells such that they are substantially uniformly spaced from the central drainage well.

39. The method of claim 34, further comprising forming the two or more exterior drainage wells to intersect multiple subterranean zones, each of the two or more exterior drainage wells capable of draining fluids from the multiple subterranean zones.

40. The method of claim 34, further comprising forming a enlarged cavity from one or more of the exterior drainage wells proximate one or more of the subterranean zones.

41. The method of claim 34, wherein forming the central drainage well comprises forming an entry well.

42. The method of claim 34, wherein forming the central drainage well comprises forming a substantially vertical central drainage well.

43. The method of claim 34, further comprising forming each exterior drainage well substantially vertically downward for a distance.

44. The method of claim 34, comprising forming three or more exterior drainage wells.

45. The method of claim 34, comprising forming four or more exterior drainage wells.

46. The method of claim 34, comprising forming six or more exterior drainage wells.

* * * * *